US008271272B2

(12) United States Patent
Ehara et al.

(10) Patent No.: US 8,271,272 B2
(45) Date of Patent: Sep. 18, 2012

(54) SCALABLE ENCODING DEVICE, SCALABLE DECODING DEVICE, AND METHOD THEREOF

(75) Inventors: Hiroyuki Ehara, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1638 days.

(21) Appl. No.: 11/587,379

(22) PCT Filed: Apr. 19, 2005

(86) PCT No.: PCT/JP2005/007438

§ 371 (c)(1),
(2), (4) Date: Oct. 24, 2006

(87) PCT Pub. No.: WO2005/112005

PCT Pub. Date: Nov. 24, 2005

(65) Prior Publication Data

US 2007/0223577 A1 Sep. 27, 2007

(30) Foreign Application Priority Data

Apr. 27, 2004 (JP) ..... 2004-132113
Sep. 6, 2004 (JP) ..... 2004-259036

(51) Int. Cl.
*G10L 19/00* (2006.01)

(52) U.S. Cl. .... 704/219; 704/203; 704/205; 375/240.03

(58) Field of Classification Search ..... None
See application file for complete search history.

(56) References Cited

U.S. PATENT DOCUMENTS 5,953,697 A * 9/1999 Lin et al. ..... 704/225
(Continued)

FOREIGN PATENT DOCUMENTS

JP 11030997 2/1999
(Continued)

OTHER PUBLICATIONS

Ehara et al., "Predictive VQ for Bandwidth Scalable LSP Quantization," Proceeding of the 2005 IEEE International Conference on Acoustics, Speech and Signal Procedding, IEEE, vol. 1, pp. 137-140, XP010791993(Mar. 2005).*

(Continued)

*Primary Examiner* — Sath V Perungavoor
*Assistant Examiner* — Mohammed Jebari
(74) *Attorney, Agent, or Firm* — Dickinson Wright PLLC

(57) ABSTRACT

There is disclosed a scalable encoding device capable of increasing the conversion performance from a narrow-band LSP to a wide-band LSP (prediction accuracy when predicting the wide-band LSP from the narrow-band LSP) and realizing a high-performance band scalable LSP encoding. The device includes a conversion coefficient calculation unit (109) for calculating a conversion coefficient by using a narrow-band quantization LSP which has been outputted from a narrow-band LSP encoding unit (103) and a wide-band quantization LSP which has been outputted from a wide-band LSP encoding unit (107). The wide-band LSP encoding unit (107) multiplies the narrow-band quantization LSP with the conversion coefficient inputted from the conversion coefficient calculation unit (109) so as to convert it into a wide-band LSP. The wide-band LSP is multiplied by a weight coefficient to calculate a prediction wide-band LSP. The wide-band LSP encoding unit (107) encodes an error signal between the obtained prediction wide-band LSP and the wide-band LSP so as to obtain a wide-band quantization LSP.

18 Claims, 22 Drawing Sheets

U.S. PATENT DOCUMENTS

| | | | | |
|---|---|---|---|---|
| 6,208,957 | B1 | 3/2001 | Nomura | |
| 2004/0015346 | A1* | 1/2004 | Yasunaga et al. | 704/219 |
| 2004/0111257 | A1* | 6/2004 | Sung et al. | 704/219 |

FOREIGN PATENT DOCUMENTS

JP 2003 241799 8/2003

OTHER PUBLICATIONS

J. Epps, W. H. Holmes, "A New Technique for Wideband Enhancement of Coded Narrowband Speech". IEEE Workshop on Speech Coding, Porvoo, Finland, 1999.*

Supplementary European Search Report Dated Mar. 4, 2008.

H. Ehara, et al.; "Predictive VQ for Bandwidth Scalable LSP Quantization," Acoustics Speech, and Signal Processing, 2005. Proceedings. (ICASSP '05). IEEE International Conference on Philadelphia, Pennsylvania, USA Mar. 18-23, 2005, Piscataway, NJ, USA, IEEE, Mar. 18, 2005, pp. 137-140.

PCT International Search Report dated Sep. 20, 2005.

H. Ebara, et al.; "Kyotaiiki-Kotaiiki Yosoku Model ni Motozuku Taiiki Scalable LSP Ryoshika," Dai 3 Kai Forum on Information Technology Koen Ronbunshu, Aug. 20, 2004, LG-004, pp. 139-141.

Translated by Furui, Tasaki, Kodera, Watanabe, "Vector Ryoshika to Joho Assuhuku," Koronasha, Nov. 10, 1998, pp. 698-700.

K. Koishida, et al.; "Enchancing MPEG-4 CELP by jointly optimized inter/intra-frame LSP predictors," Proc. IEEE Workshop on Speech Coding, 2000, pp. 90-92.

K. Koishida, et al.; "A 16-KBIT/S Bandwidth Scalable Audio Coder Based on the G.729 Standard," IEEE, Proc. ICASSP 2000, pp. 1149-1152.

R. Salami. et al.; "Design and Description of CS—ACELP: A Toll Quality 8 kb/s Speech Coder," IEEE Trans. on Speech and Audio Processing, vol. 6, No. 2, Mar. 1998, pp. 116-130.

K. K. Paliwal, et al.; "Efficient Vector Quantization of LPC Parameters at 24 Bits/Frame," IEEE Trans. on Speech and Audio Processing, vol. 1, No. 1, Jan. 1993, pp. 3-14.

* cited by examiner

SCALABLE ENCODING DEVICE, SCALABLE DECODING DEVICE, AND METHOD THEREOF

TECHNICAL FIELD

The present invention relates to a scalable encoding apparatus, scalable decoding apparatus, scalable encoding method and scalable decoding method used when a voice communication is carried out in a mobile communication system and packet communication system using an Internet protocol or the like.

BACKGROUND ART

In a voice communication using packets such as VoIP (Voice over IP), a encoding scheme having frame loss tolerance when encoding voice data is desired. This is because in a packet communication represented by Internet communication, packets are sometimes lost in a transmission path due to congestion or the like.

As one of methods for increasing frame loss tolerance, there is an approach which makes influences of frame loss as small as possible by performing decoding processing from other parts even when some part of transmission information is lost (for example, see Patent Document 1). Patent Document 1 discloses a method of transmitting core layer encoded information and enhanced layer encoded information packed in separate packets using scalable encoding. Also, one of packet communication applications is a multicast communication (one-to-many communication) using a network on which thick channels (broadband channels) and thin channels (channels of low transmission rates) coexist. Even when communications are carried out among many spots on such heterogeneous networks, if encoded information is hierarchically structured in accordance with the respective networks, there is no necessity for sending encoded information which differs for every network, so that scalable encoding is effective.

As an example of a band scalable encoding technology which has scalability in the signal bandwidth, that is, in the frequency axis direction based on a CELP scheme which enables high efficiency encoding of a voice signal, there is a technology disclosed in Patent Document 2. Patent Document 2 shows an example of a CELP scheme which expresses spectral envelope information of a voice signal using LSP (line spectrum pair) parameters. Here, a band scalable LSP encoding method is realized by converting quantized LSP parameters (narrowband encoding LSP) obtained at a encoding section (core layer) for narrowband voice to LSP parameters for wideband voice encoding using following (Expression 1) and using the converted LSP parameters at a encoding section (enhanced layer) for wideband voice.

$$fw(i)=0.5\times fn(i)[i=0,\ldots,P_n-1]=0.0[i=P_n,\ldots,P_w-1] \quad \text{(Expression 1)}$$

where fw(i) denotes an ith-order LSP parameter in a wideband signal, fn(i) denotes an ith-order LSP parameter in a narrowband signal, $P_n$ denotes an LSP analysis order of the narrowband signal and $P_w$ denotes an LSP analysis order of the wideband signal, respectively.

However, since Patent Document 2 explains a case where the sampling frequency is 8 kHz for a narrowband signal, the sampling frequency is 16 kHz for a wideband signal and the wideband LSP analysis order is twice the narrowband LSP analysis order as an example, the conversion from narrowband LSP to wideband LSP can be performed using a simple expression as shown in (Expression 1). However, since the position where a $P_n$th-order LSP parameter on the low-order side of wideband LSP exists is determined for the whole wideband signal including a $(P_w-P_n)$th order on the high-order side, it does not always correspond to the $P_n$th-order LSP parameter of narrowband LSP. For this reason, the conversion shown by (Expression 1) is not able to obtain high conversion efficiency (which may also be referred to as "prediction accuracy" if wideband LSP is predicted from narrowband LSP), and a wideband LSP coder designed based on (Expression 1) leaves room for improving encoding performance.

For example, Non-Patent Document 1 discloses a method of determining optimum conversion coefficient β(i) per order using an algorithm of optimizing the conversion coefficient as shown in following (Expression 2) instead of setting the conversion coefficient by which the ith-order narrowband LSP parameter in (Expression 1) is multiplied to 0.5.

$$fw_n(i)=\alpha(i)\times L(i)+\beta(i)\times fn_n(i) \quad \text{(Expression 2)}$$

where fw_n(i) is the ith-order quantized wideband LSP parameter in an nth frame, α (i)×L(i) is an ith-order element of a vector obtained by quantizing a predicted error signal element (α (i) is an ith-order weighting factor), L(i) is an LSP predictive residual vector, β (i) is a weighting factor for prediction wideband LSP and fn_n(i) is a narrowband LSP parameter in the nth frame. By such optimization of a set of conversion coefficients, although it is an LSP coder having the same configuration as Patent Document 2, higher encoding performance is realized.

Patent Document 1: Japanese Patent Application Laid-Open No. 2003-241799

Patent Document 2: Japanese Patent Application Laid-Open No. HEI 11-30997

Non-Patent Document 1: K. Koishida et al, "Enhancing MPEG-4 CELP by jointly optimized inter/intra-frame LSP predictors," IEEE Speech Encoding Workshop 2000, Proceeding, pp. 90-92, 2000

DISCLOSURE OF INVENTION

Problems to be Solved by the Invention

However, the position of the $P_n$th-order LSP parameter on the low-order side of wideband LSP is determined for the whole wideband signal, and, therefore, when individual LSP parameters (LSP parameter per analysis frame) are focused on, the value of optimum conversion coefficient β(i) changes over time (depending on the frame). Therefore, the technology disclosed in Patent Document 2 has the following problem.

FIG. 1 shows an example of narrowband LSP parameters obtained by performing LSP analysis, at $P_w$=18, on a signal obtained by performing band limiting on a wideband signal, that is, a signal obtained by performing down-sampling and then upsampling on the wideband signal to bring the result back to the original sampling frequency.

Furthermore, FIG. 2 shows an example of wideband LSP parameters obtained by carrying out LSP analysis at $P_w$=18 on the wideband signal corresponding to the narrowband LSP parameters shown in FIG. 1. In these figures, the horizontal axis shows a time scale (analysis frame number) and the vertical axis shows a normalized frequency (assume that 1.0 is a Nyquist frequency, and the frequency is 8 kHz in the example of the figure).

As shown in these figures, it is understandable that even the LSP parameters obtained under the same conditions except for difference in frequency bands of the signal—that is, the LSP parameters obtained by carrying out an LSP analysis at the same sampling frequency (16 kHz) with the same analysis order—the correspondence between ($P_w/2$)th-order LSP parameter on the low-order side obtained from a signal band-limited to the narrowband and ($P_w/2$)th-order LSP parameter on the low-order side obtained from a wideband signal changes over time. This change is caused by a difference not included in the narrowband signal and in the frequency component (mainly a high-frequency component) included in the wideband signal.

FIG. 3 shows ideal conversion coefficients when narrowband LSP obtained per order is converted to wideband LSP using the LSP data shown in FIG. 1 and FIG. 2. Here, the conversion coefficient is a value obtained by dividing wideband LSP by narrowband LSP, and the horizontal axis shows a time scale (analysis frame number) and cases where the order is 0th, 4th and 8th are shown as an example.

As is also clear from this figure, the values of ideal conversion coefficients change overtime. That is, the conversion coefficient upon conversion of narrowband LSP to wideband LSP, in other words, the ideal value of the conversion coefficient upon predicting wideband LSP from narrowband LSP changes over time. Therefore, even when the conversion coefficient obtained using the design technique shown in Non-Patent Document 1 is used, if the conversion coefficient is a fixed value, the ideal conversion coefficient changing over time cannot be expressed correctly.

Although the case is shown as an example where the sampling frequency and the analysis order are the same and only the signal band is different in order to meet the condition of the LSP analysis, the same applies when an LSP analysis is carried out at an order which is lower than the wideband LSP using a down-sampled signal. This can be easily understood by those skilled in this field. However, since the condition of the LSP analysis is different, the correspondence between narrowband LSP and wideband LSP becomes worse than the above-described example.

Thus, it is therefore an object of the present invention to provide a scalable encoding apparatus, scalable decoding apparatus, scalable encoding method and scalable decoding method capable of improving performance of conversion from narrowband LSP to wideband LSP, that is, prediction accuracy when predicting wideband LSP from narrowband LSP, and realizing high performance band scalable LSP encoding.

Means for Solving the Problem

The scalable encoding apparatus according to the present invention is a scalable encoding apparatus that generates a quantized LSP parameter in a narrowband and wideband having scalability in a frequency axis direction from an input signal and employs a configuration having: a narrowband encoding section that codes the LSP parameter of the input signal in the narrowband and generates a first quantized LSP parameter in the narrowband; a conversion section that converts a frequency band of said first quantized LSP parameter to a wideband; a wideband encoding section that codes the LSP parameter of the input signal in the wideband using said first quantized LSP parameter after conversion to the wideband and generates a second quantized LSP parameter in the wideband; and a calculation section that calculates a set of conversion coefficients used by said conversion section based on a relationship between said first and second quantized LSP parameters generated in the past.

Advantageous Effect of the Invention

According to the present invention, it is possible to improve performance of conversion from narrowband LSP to wideband LSP and realize high performance band scalable LSP encoding.

BEST MODE FOR CARRYING OUT THE INVENTION

Hereinafter, embodiments of the present invention will be explained in detail with reference to the attached drawings.

Embodiment 1

Figure 1:
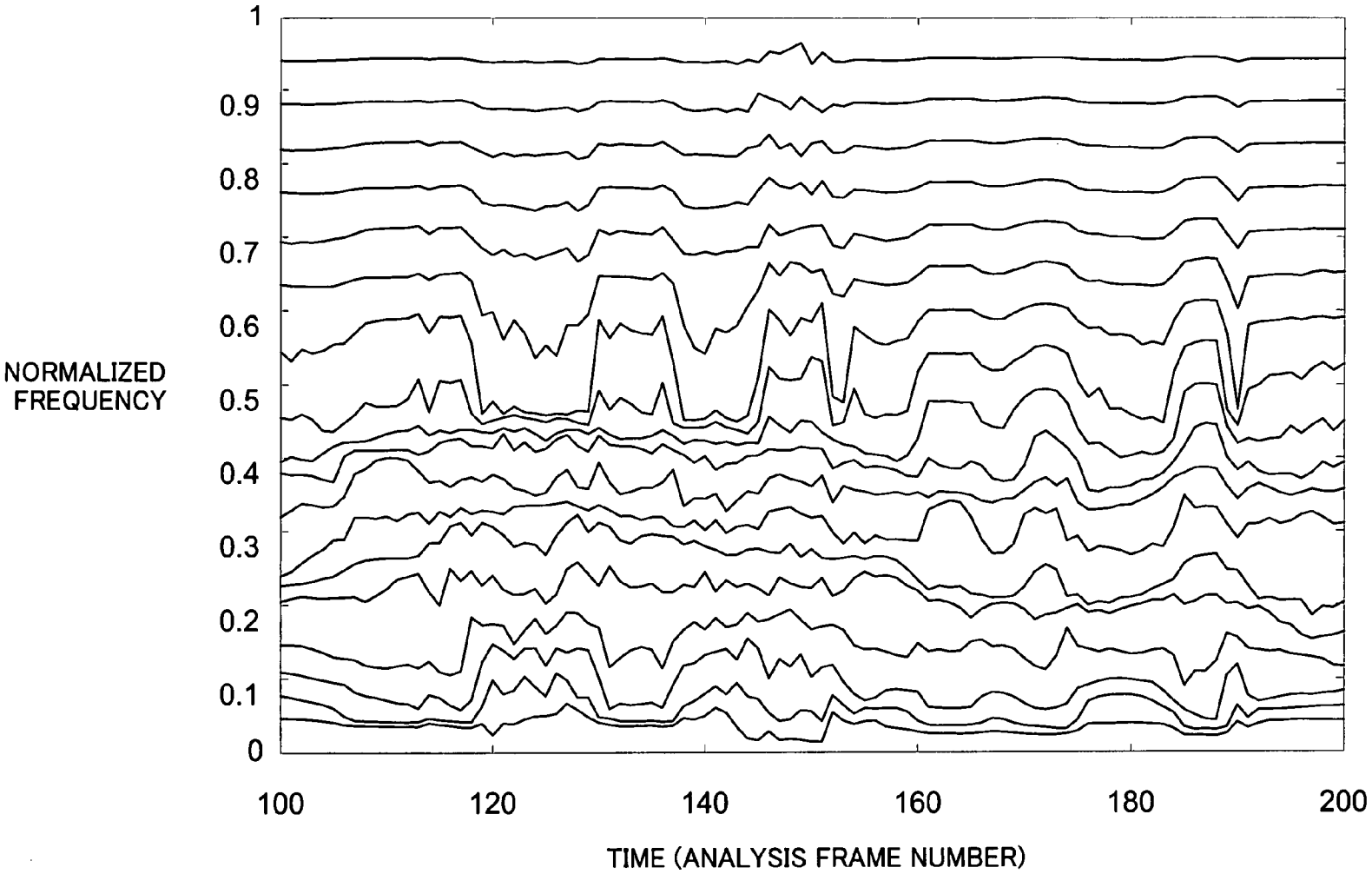
FIG. 1 is a view illustrating an example of LSP parameters of a narrowband speech signal.
Figure 2:
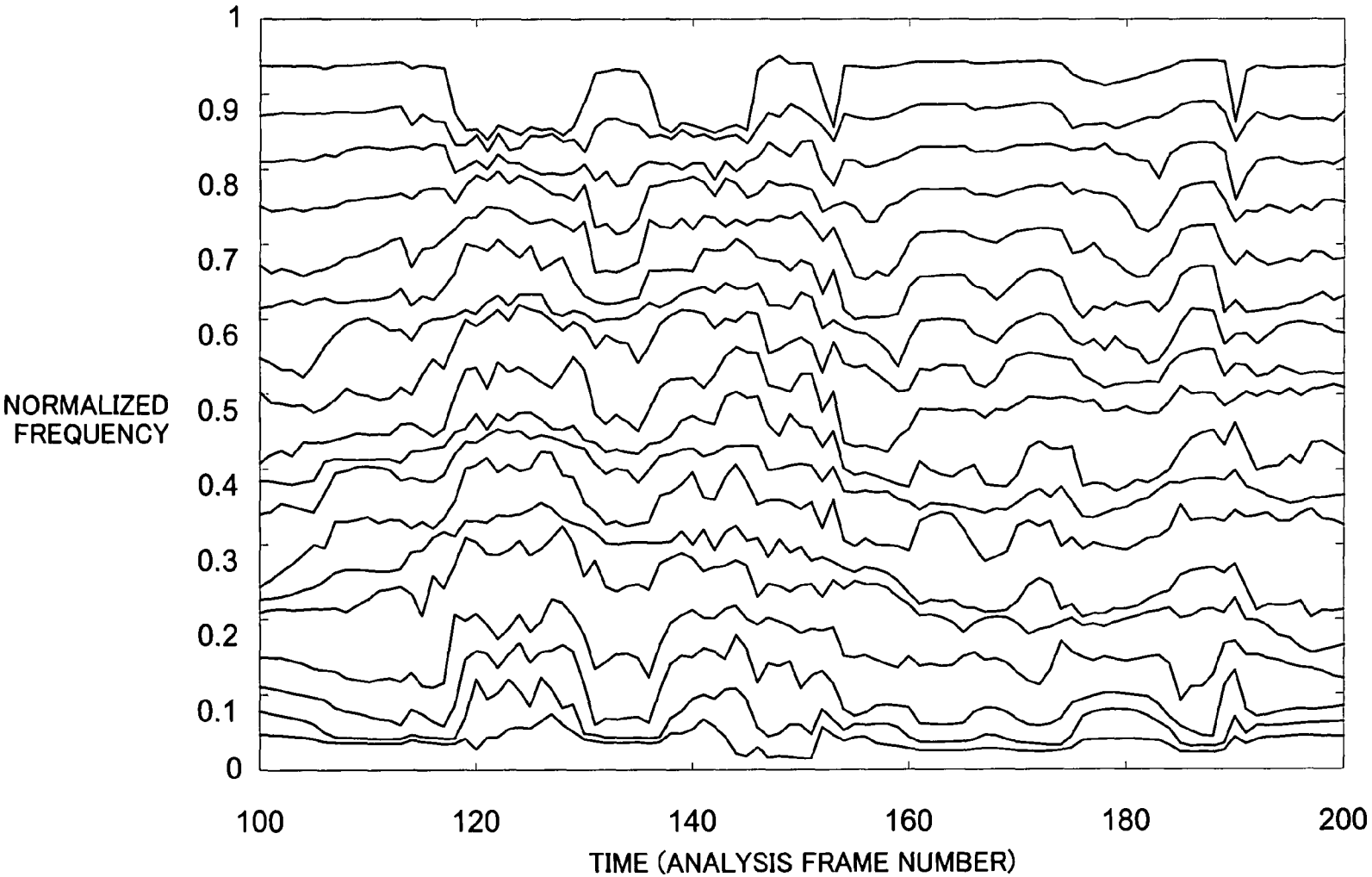
FIG. 2 is a view illustrating an example of LSP parameters of a wideband speech signal.
Figure 3:
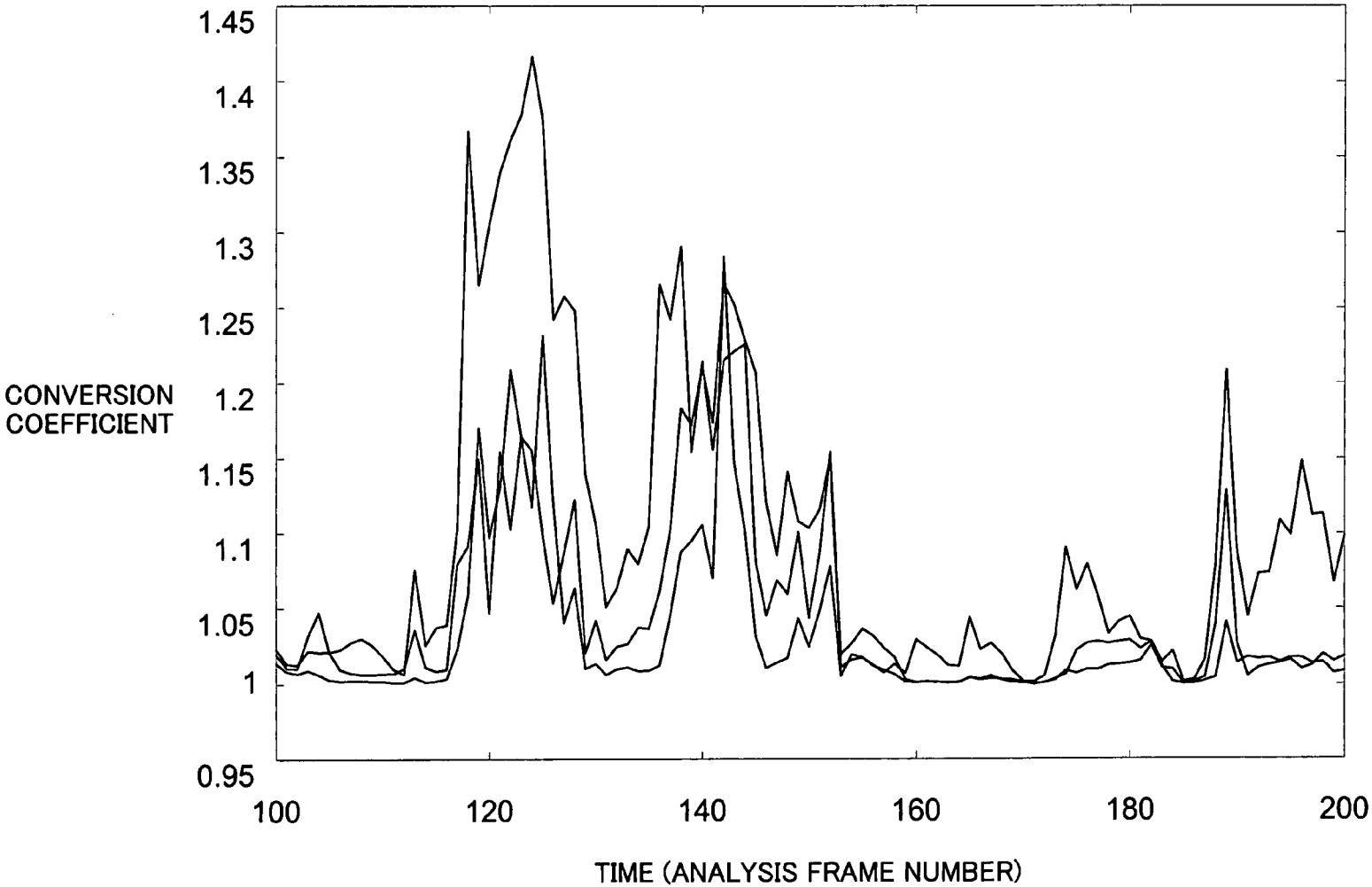
FIG. 3 is a view illustrating ideal conversion coefficients.
Figure 4:
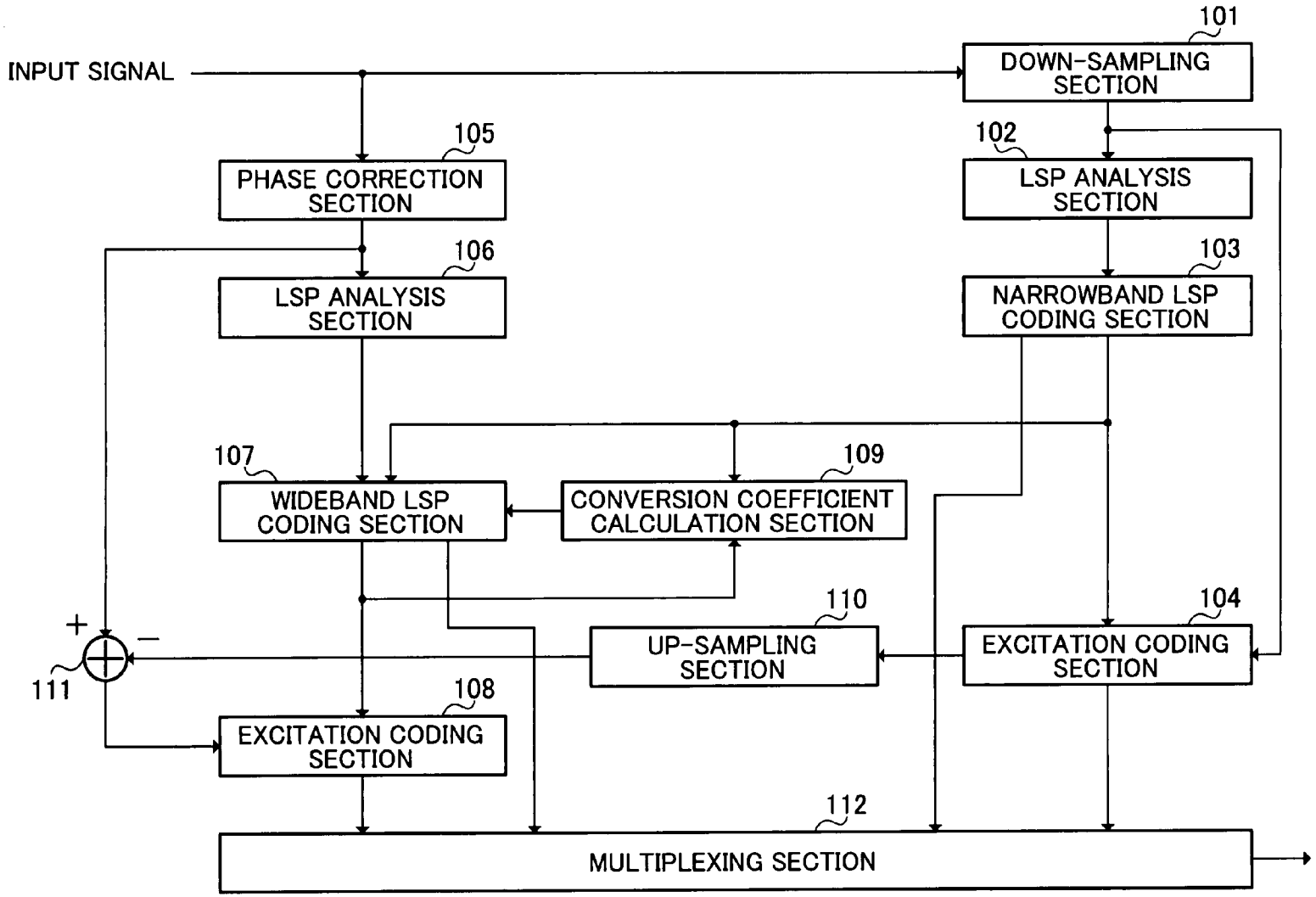
FIG. 4 is a block diagram showing the main configuration of a scalable encoding apparatus according to Embodiment 1.

FIG. 4 is a block diagram showing the main configuration of a scalable encoding apparatus according to Embodiment 1 of the present invention.

The scalable encoding apparatus according to this embodiment is provided with: down-sampling section 101; LSP analysis section (for a narrowband signal) 102; narrowband LSP encoding section 103; excitation encoding section (for a narrowband signal) 104; phase adjustment section 105; LSP analysis section (for a wideband signal) 106; wideband LSP encoding section 107; excitation encoding section (for a wideband signal) 108; conversion coefficient calculation section 109; up-sampling section 110; adder 111; and multiplexing section 112.

The sections of the scalable encoding apparatus according to this embodiment operate as follows.

Down-sampling section 101 performs down-sampling processing on an input voice signal and outputs a narrowband signal to LSP analysis section (for a narrowband signal) 102 and excitation encoding section (for a narrowband signal) 104. The input voice signal is a digitized signal and is subjected to pre-processing such as HPF (High-Pass Filtering) and background noise suppression processing if necessary.

LSP analysis section (for the narrowband signal) 102 calculates an LSP (line spectrum pair) parameter for the narrowband signal input from down-sampling section 101 and outputs the result to narrowband LSP encoding section 103.

Narrowband LSP encoding section 103 encodes the narrowband LSP parameter input from LSP analysis section (for the narrowband signal) 102 and outputs a quantized narrowband LSP parameter to wideband LSP encoding section 107, conversion coefficient calculation section 109 and excitation encoding section (for the narrowband signal) 104. Also, narrowband LSP encoding section 103 outputs the encoded data to multiplexing section 112.

Excitation encoding section (for the narrowband signal) 104 converts the quantized narrowband LSP parameter input from narrowband LSP encoding section 103 to a set of linear predictive coefficients and builds a linear predictive synthesis filter using the obtained linear predictive coefficients. Excitation encoding section 104 obtains a perceptually weighted error between the synthesized signal synthesized using this linear predictive synthesis filter and the narrowband input signal separately input from down-sampling section 101 and performs encoding on the excitation parameter at which this perceptually weighted error is minimized. The obtained encoded information is output to multiplexing section 112. Furthermore, excitation encoding section 104 generates a decoded narrowband voice signal and outputs the result to up-sampling section 110.

For narrowband LSP encoding section 103 or excitation encoding section (for the narrowband signal) 104, a circuit generally used in a CELP-type voice encoding apparatus using LSP parameters can be used and, for example, the technology such as described in Patent Document 2 or ITU-T Recommendation G.729 can be used.

Up-sampling section 110 inputs the decoded narrowband voice signal synthesized by excitation encoding section 104, performs up-sampling processing and outputs the signal to adder 111.

Adder 111 inputs the input signal after the phase adjustment from phase adjustment section 105 and decoded narrowband voice signal subjected to up-sampling by up-sampling section 110, calculates a difference signal between both signals and outputs the result to excitation encoding section (for the wideband signal) 108.

Phase adjustment section 105 is intended to adjust a phase difference (delay) produced in down-sampling section 101 and up-sampling section 110, carries out processing of delaying the input signal by the delay produced in the linear phase low pass filter when down-sampling processing and up-sampling processing are carried out using a linear phase low pass filter and decimator/expander and outputs the signal to LSP analysis section (for the wideband signal) 106 and adder 111.

LSP analysis section (for the wideband signal) 106 inputs the wideband signal output from phase adjustment section 105, carries out a publicly known LSP analysis and outputs the obtained wideband LSP parameter to wideband LSP encoding section 107.

Conversion coefficient calculation section 109 calculates a set of conversion coefficients using the quantized narrowband LSP output in the past from narrowband LSP encoding section 103, the quantized wideband LSP output in the past from wideband LSP encoding section 107 and outputs the result to wideband LSP encoding section 107.

Wideband LSP encoding section 107 multiplies the quantized narrowband LSP input from narrowband LSP encoding section 103 by the conversion coefficient input from conversion coefficient calculation section 109 to convert the quantized narrowband LSP to wideband LSP, and multiplies this wideband LSP by a weighting factor to obtain predicted wideband LSP. Wideband LSP encoding section 107 then encodes an error signal between the wideband LSP input from LSP analysis section (for the wideband signal) 106 and the obtained predicted wideband LSP using a vector quantization technique or the like and outputs the obtained quantized wideband LSP to excitation encoding section (for the wideband) 108. Here, quantized LSP is expressed as following (Expression 3).

$$fw_n(i)=\alpha(i)\times L(i)+\beta(i)\times\{fw_n-1(i)/fn_n-1(i)\}\times fn_n(i) \quad \text{(Expression 3)}$$

where, fw_n(i) is the ith-order quantized wideband LSP parameter in an nth frame, $\alpha(i)\times L(i)$ is an ith-order element of the vector obtained by quantizing the prediction error signal ($\alpha(i)$ is the ith-order weighting factor), L(i) is an LSP predictive residual vector, $\beta(i)$ is a weighting factor for predicted wideband LSP, fw_n−1(i) is a quantized wideband LSP parameter in an (n−1)th frame, fn_n−1(i) is a quantized narrowband LSP parameter in the (n−1)th frame and fn_n(i) is a narrowband LSP parameter in the nth frame.

On the other hand, wideband LSP encoding section 107 outputs the obtained code information to multiplexing section 112. Weighting factor $\alpha(i)$ by which above-described LSP predictive residual vector is multiplied may be a fixed value of 1.0 or may be a constant obtained separately through learning or may be obtained by storing a plurality of coefficients separately obtained through learning in a code book and selecting one among the coefficients.

Excitation encoding section (for the wideband) 108 converts the quantized wideband LSP parameter input from wideband LSP encoding section 107 to a set of linear predictive coefficients and builds a linear predictive synthesis filter using the obtained linear predictive coefficients. Excitation encoding section 108 then calculates a perceptually weighted error between the synthesized signal synthesized using this linear predictive synthesis filter and the input signal subjected to phase adjustment and determines an excitation parameter at which this perceptually weighted error is minimized. To be more specific, the error signal between the wideband input signal and the decoded narrowband signal after the up-sampling are separately input to excitation encoding section 108 from adder 111, an error between this error signal and the decoded signal generated by excitation encoding section 108 is calculated and the excitation parameter is determined so that this error becomes a minimum in a perceptually weighted domain. The obtained code information on the excitation parameter is output to multiplexing section 112. This excitation encoding is disclosed, for example, in "K. Koishida et al, "A 16-kbit/s bandwidth scalable audio coder based on the G.729 standard," IEEE Proc. ICASSP 2000, pp. 1149-1152, 2000."

Multiplexing section 112 inputs the encoded information of narrowband LSP from narrowband LSP encoding section 103, excitation encoded information of the narrowband signal from excitation encoding section (for the narrowband) 104, encoded information of wideband LSP from wideband LSP encoding section 107 and excitation encoded information of the wideband signal from excitation encoding section (for the wideband signal) 108. Multiplexing section 112 multiplexes these pieces of information and sends out the result to the transmission path as a bit stream. The bit stream is made into a frame as a transmission channel frame or is packetized according to the specification of the transmission path. Also, to improve tolerance to transmission path errors, error protection or an error detection code is added and interleave processing or the like is applied.

Figure 5:
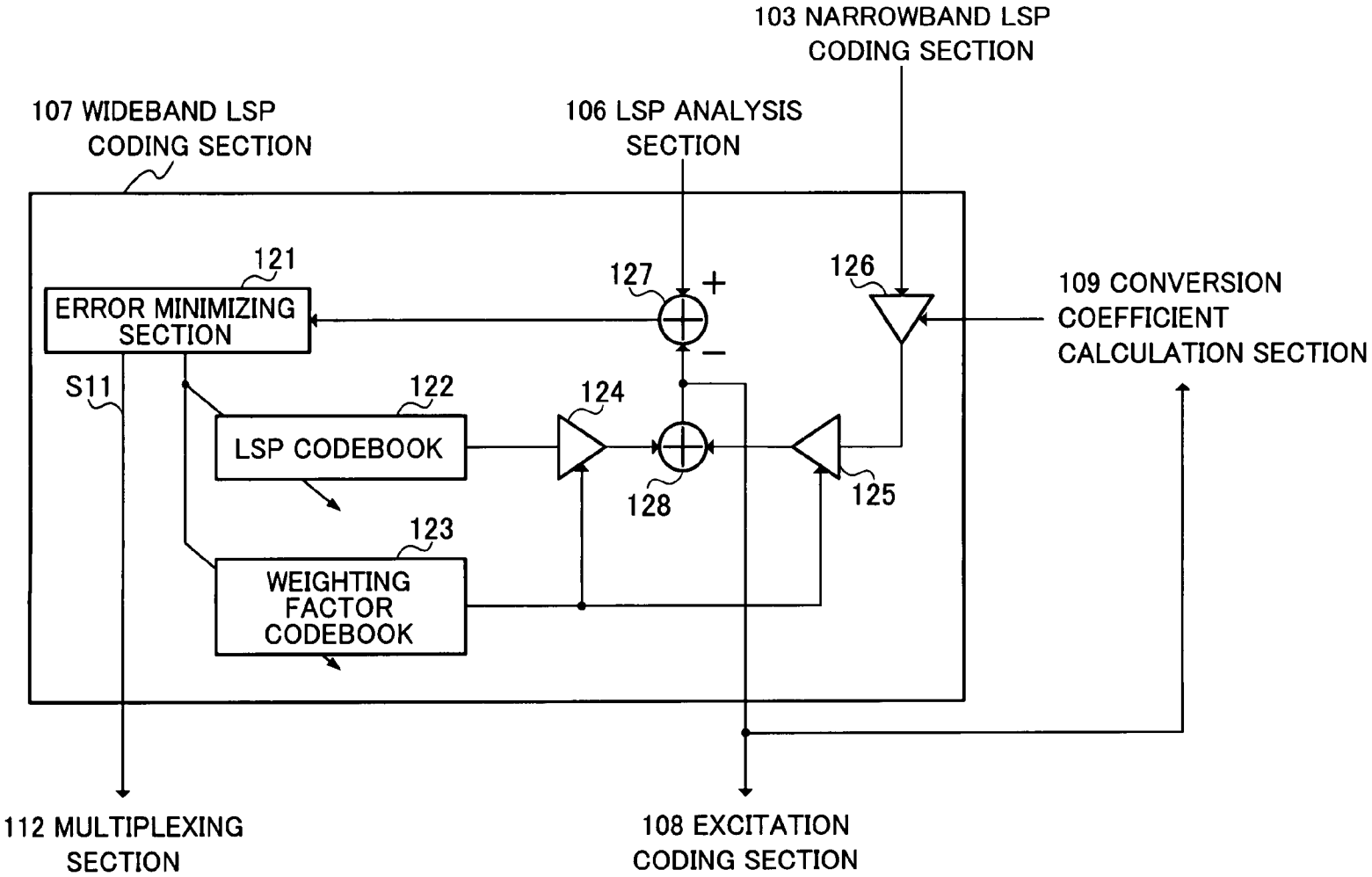
FIG. 5 is a block diagram showing the main configuration inside a wideband LSP encoding section according to Embodiment 1.

FIG. 5 is a block diagram showing the main configuration inside above-described wideband LSP encoding section 107.

This wideband LSP encoding section 107 is provided with: error minimizing section 121; LSP codebook 122; weighting factor codebook 123; amplifiers 124 to 126; and adders 127 and 128.

Adder 127 calculates an error between the LSP parameter input from LSP analysis section 106 and is subjected to quantization and a quantized LSP parameter candidate input from adder 128, and outputs the calculated error to error minimizing section 121. This error calculation may be a square error between the input LSP vectors. Furthermore, the perceptual quality can be further improved if weighting is performed according to the features of the input LSP vector. For example, according to ITU-T Recommendation G.729, an error is minimized using a weighted square error (weighted Euclidean distance) in Expression (21) of Chapter 3.2.4 (Quantization of the LSP coefficients).

Error minimizing section 121 selects an LSP vector and a weighting factor vector at which the error output from adder 127 is minimized from the inside the LSP codebook 122 and the weighting factor codebook 123 respectively, encodes the corresponding index, and outputs the result to multiplexing section 112 (S11).

LSP codebook 122 outputs the held LSP vector to amplifier 124. Here, the LSP vector held in LSP codebook 122 is a predictive residual vector of the wideband LSP predicted based on the quantized narrowband LSP output from amplifier 125 (for the wideband LSP input from LSP analysis section 106).

Weighting factor codebook 123 selects one set from the held weighting factor sets and outputs a coefficient for amplifier 124 and a coefficient for amplifier 125 from the selected weighting factor set to amplifiers 124 and 125. This weighting factor set consists of weighting factors provided per order of LSP for the amplifiers 124 and 125.

Amplifier 124 multiplies the LSP vector input from LSP codebook 122 by a weighting factor for amplifier 124 output from weighting factor codebook 123 and outputs the result to adder 128.

Amplifier 125 multiplies the vector of wideband LSP input from amplifier 126, that is, the vector of the wideband LSP obtained by converting narrowband LSP after quantization by a weighting factor for amplifier 125 output from weighting factor codebook 123 and outputs the result to adder 128.

Adder 128 calculates the sum of the LSP vectors output from amplifier 124 and amplifier 125 and outputs the sum to adder 127. Furthermore, the sum of the LSP vectors which have been determined to have a minimized error by error minimizing section 121 is output to excitation encoding section 108 and conversion coefficient calculation section 109 as the quantized wideband LSP parameter. When the LSP parameter output as the quantized wideband LSP parameter does not satisfy the stability condition (the stability condition is met when the nth LSP is greater than each of the 0th- to (n−1)th-order LSP, that is, the value of LSP increases in ascending order of the order), adder 128 adds operation so as to satisfy the stability condition of LSP. Even when the interval between neighboring quantized LSPs is smaller than a predetermined interval, an operation is generally performed so that the interval can be equal to or greater than the predetermined interval.

Amplifier 126 multiplies the LSP parameter input from narrowband LSP encoding section 103 by the coefficient input from conversion coefficient calculation section 109 and outputs the result to amplifier 125. The LSP parameter input to amplifier 126 from narrowband LSP encoding section 103 may be quantization result at narrowband LSP encoding section 103 as is, but it is more preferable to up-sample the LSP parameter so as to match the sampling frequency of the wideband signal and match the order of wideband LSP. As the method of this up-sampling, although a method of up-sampling the impulse response of the LPC synthesis filter obtained from narrowband LSP, obtaining autocorrelation from the up-sampled impulse response (for example, see Patent Document 2) and converting the obtained autocorrelation coefficient to an LSP of the desired order or the like may be used, this is by no means limiting.

Figure 6:
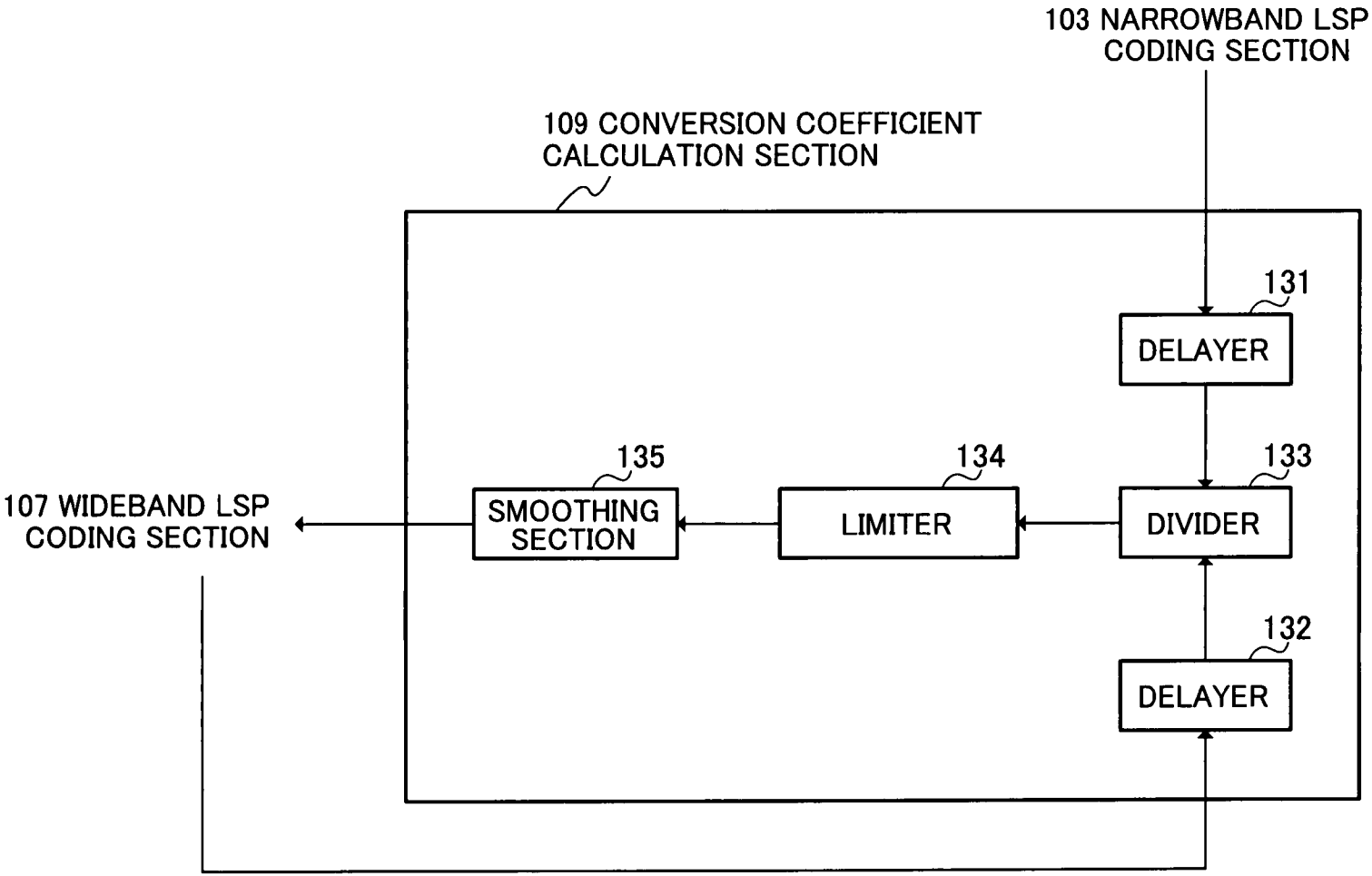
FIG. 6 is a block diagram showing the main configuration inside a conversion coefficient calculation section according to Embodiment 1.

FIG. 6 is a block diagram showing the main configuration inside conversion coefficient calculation section 109 shown in FIG. 4.

This conversion coefficient calculation section 109 is provided with: delayers 131 and 132; divider 133; limiter 134; and smoothing section 135.

Delayer 131 delays the narrowband LSP parameter input from narrowband LSP encoding section 103 by one processing unit time (update period of the LSP parameter) and outputs the result to divider 133. As described above, narrowband LSP input from narrowband LSP encoding section 103 may be the parameter narrowband LSP as is, but may be more preferably up-sampled so as to match the order.

Delayer 132 delays the wideband LSP parameter input from wideband LSP encoding section 107 by one processing unit time (update period of the LSP parameter) and outputs the result to divider 133.

Divider 133 divides the wideband LSP parameter input from delayer 132 and quantized one processing unit time before by the narrowband LSP parameter input from delayer 131 and quantized one processing unit time before, and outputs the division result to limiter 134. When the order of the narrowband LSP parameter output from delayer 131 is different from the order of the wideband LSP parameter output from delayer 132, divider 133 performs a division by the amount corresponding to the smaller order (normally, this is equal to the order of the narrowband LSP parameter) and outputs the result.

Limiter 134 clips the division result input from divider 133 at preset upper limit and lower limit (i.e. this processing resets the division result to this upper limit or this lower limit when the value exceeds the upper limit or falls below the lower limit respectively) and outputs the clipping result to smoothing section 135. The upper limit and the lower limit may be identical for all orders but it is more preferable to set optimum one per order.

Smoothing section 135 smoothes the division results in terms of time after the clipping input from limiter 134 and outputs the results to wideband LSP encoding section 107 as a set of conversion coefficients. This smoothing processing can be realized using, for example, (Expression 4) below.

$$X_n(i)=K\times X_{n-1}(i)+(1-K)\times\gamma(i) \quad \text{(Expression 4)}$$

where, $X_n(i)$ is the conversion coefficient which is applied to the ith-order narrowband LSP parameter in the nth processing unit time, K is a smoothing coefficient and takes the value of $0\leqq K<1$. $\gamma(i)$ is the division result for the ith-order LSP parameter output from limiter 134.

The scalable encoding apparatus according to this embodiment has been explained in detail so far.

Figure 7:
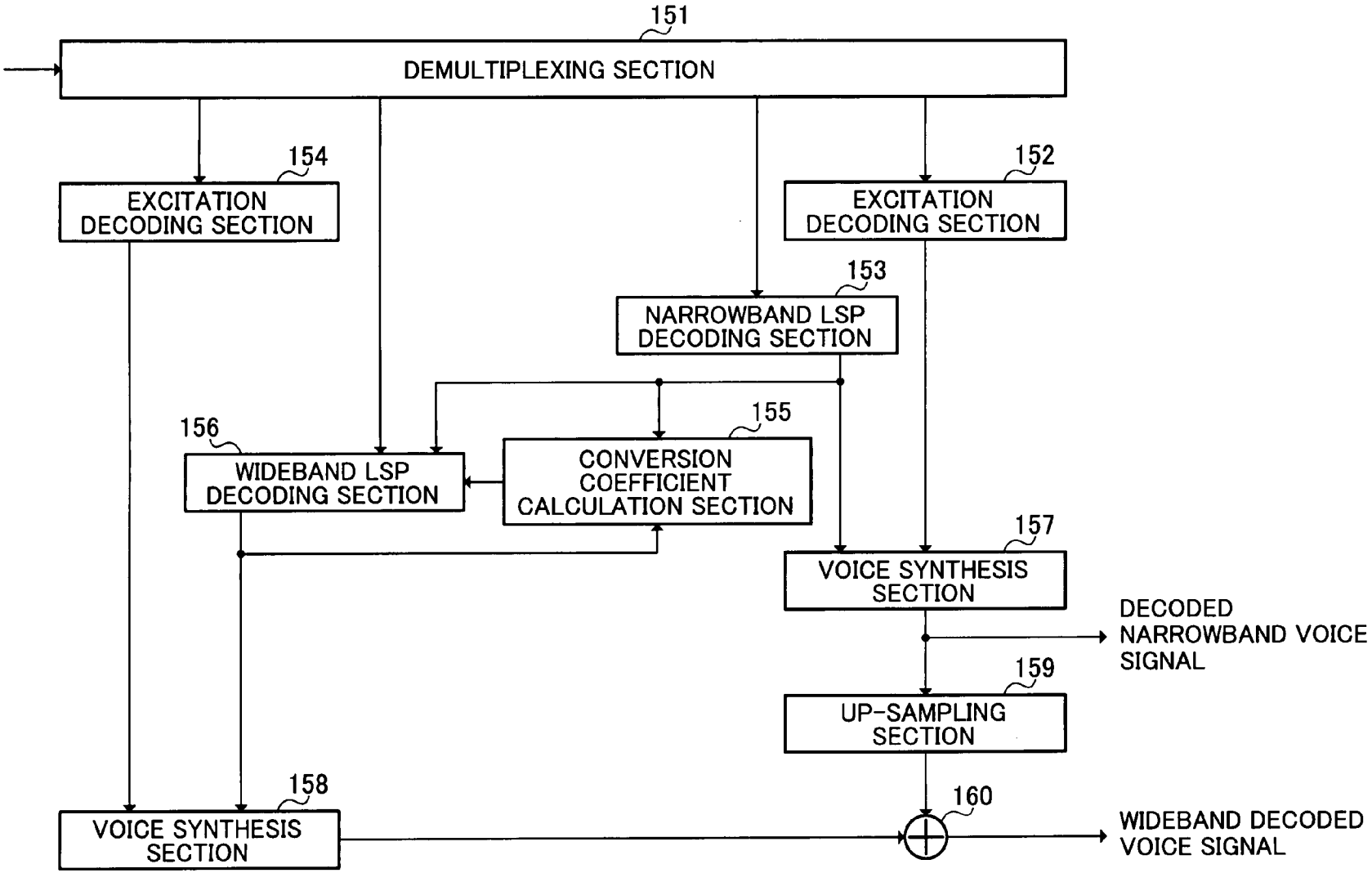
FIG. 7 is a block diagram showing the main configuration of a scalable decoding apparatus according to Embodiment 1.

FIG. 7 is a block diagram showing the main configuration of the scalable decoding apparatus that decodes encoded information encoded by the above-described scalable encoding apparatus.

This scalable decoding apparatus is provided with: demultiplexing section 151; excitation decoding section (for the narrowband signal) 152; narrowband LSP decoding section 153; excitation decoding section (for the wideband signal) 154; conversion coefficient calculation section 155; wideband LSP decoding section 156; voice synthesis section (for the narrowband signal) 157; voice synthesis section (for the wideband signal) 158; up-sampling section 159; and adder 160.

Demultiplexing section 151 receives the encoded information which has been encoded by the above-described scalable encoding apparatus and separates the encoded information into pieces of encoded information of the parameters and outputs narrowband excitation encoded information to excitation decoding section (for the narrowband signal) 152, narrowband LSP encoded information to narrowband LSP decoding section 153, wideband excitation encoded information to excitation decoding section (for the wideband signal) 154 and wideband LSP encoded information to wideband LSP decoding section 156, respectively.

Excitation decoding section (for the narrowband signal) 152 decodes the encoded information of the narrowband excitation signal input from demultiplexing section 151 using processing reversing the processing carried out by excitation encoding section (for the narrowband signal) 104 of the above-described scalable encoding apparatus, and outputs the quantized narrowband excitation signal to voice synthesis section (for the narrowband signal) 157.

Narrowband LSP decoding section 153 decodes the encoded information of narrowband LSP input from demultiplexing section 151 using processing reversing the processing carried out by narrowband LSP encoding section 103 of the above-described scalable encoding apparatus, and outputs the obtained quantized narrowband LSP to voice synthesis section (for the narrowband signal) 157, conversion coefficient calculation section 155 and wideband LSP decoding section 156.

Voice synthesis section (for the narrowband signal) 157 converts the quantized narrowband LSP parameter input from narrowband LSP decoding section 153 to a set of linear predictive coefficients and builds a linear predictive synthesis filter using the obtained linear predictive coefficients. Voice synthesis section (for the narrowband signal) 157 drives this linear predictive synthesis filter by the quantized narrowband excitation signal input from excitation decoding section (for the narrowband signal) 152 and synthesizes a decoded voice signal and outputs the result as a decoded narrowband voice signal. This decoded narrowband voice signal is output to up-sampling section 159 to obtain a wideband decoded voice signal. This decoded narrowband voice signal may be used as the final output as is. When the decoded narrowband voice signal is used as the final output as is, it is general to carry out post-processing such as post filter to improve subjective quality, and output the signal.

Up-sampling section 159 carries out up-sampling processing on the narrowband voice signal input from voice synthesis section (for the narrowband signal) 157 and outputs the result to adder 160.

Excitation decoding section (for the wideband signal) 154 decodes the encoded information of the wideband excitation signal input from demultiplexing section 151 by processing reversing the processing carried out by excitation encoding section (for the wideband signal) 108 of the above-described scalable encoding apparatus and outputs the quantized wideband excitation signal obtained to voice synthesis section (for the wideband signal) 158.

Conversion coefficient calculation section 155 calculates a set of conversion coefficients using the quantized narrowband LSP input in the past from narrowband LSP decoding section 153 and the quantized wideband LSP input in the past from wideband LSP decoding section 156 and outputs the conversion coefficients to wideband LSP decoding section 156.

Wideband LSP decoding section 156 multiplies the quantized narrowband LSP input from narrowband LSP decoding section 153 by the conversion coefficients input from conversion coefficient calculation section 155, converts narrowband LSP to wideband LSP and multiplies this wideband LSP by a weighting factor to obtain predicted wideband LSP. The same value of the weighting factor used in wideband LSP encoding section 107 of the above-described scalable encoding apparatus is used for this weighting factor. Furthermore, wideband LSP decoding section 156 decodes the quantized wideband LSP prediction residual (the error between input wideband LSP on the encoding side and above-described predicted wideband LSP) from the wideband LSP encoded information input from demultiplexing section 151. Wideband LSP decoding section 156 then sum this quantized wideband LSP prediction residual and the predicted wideband LSP already obtained above, and decodes the quantized wideband LSP. The obtained quantized wideband LSP parameter is output to voice synthesis section (for the wideband signal) 158 and conversion coefficient calculation section 155.

Voice synthesis section (for the wideband signal) 158 converts the quantized wideband LSP parameter input from wideband LSP decoding section 156 to a set of linear predictive coefficients and builds a linear predictive synthesis filter using the obtained linear predictive coefficients. Voice synthesis section (for the wideband signal) 158 drives this linear predictive synthesis filter by the quantized wideband excitation signal input from excitation decoding section (for the wideband signal) 154 and synthesizes a wideband decoded voice signal (which contains mainly a high-frequency component) and outputs the wideband decoded voice signal to adder 160.

Adder 160 sums the up-sampled narrowband decoded voice signal input from up-sampling section 159 and the wideband decoded voice signal (which contains mainly a high-frequency component) input from voice synthesis section (for the wideband signal) 158 and outputs a final wideband decoded voice signal.

Figure 8:
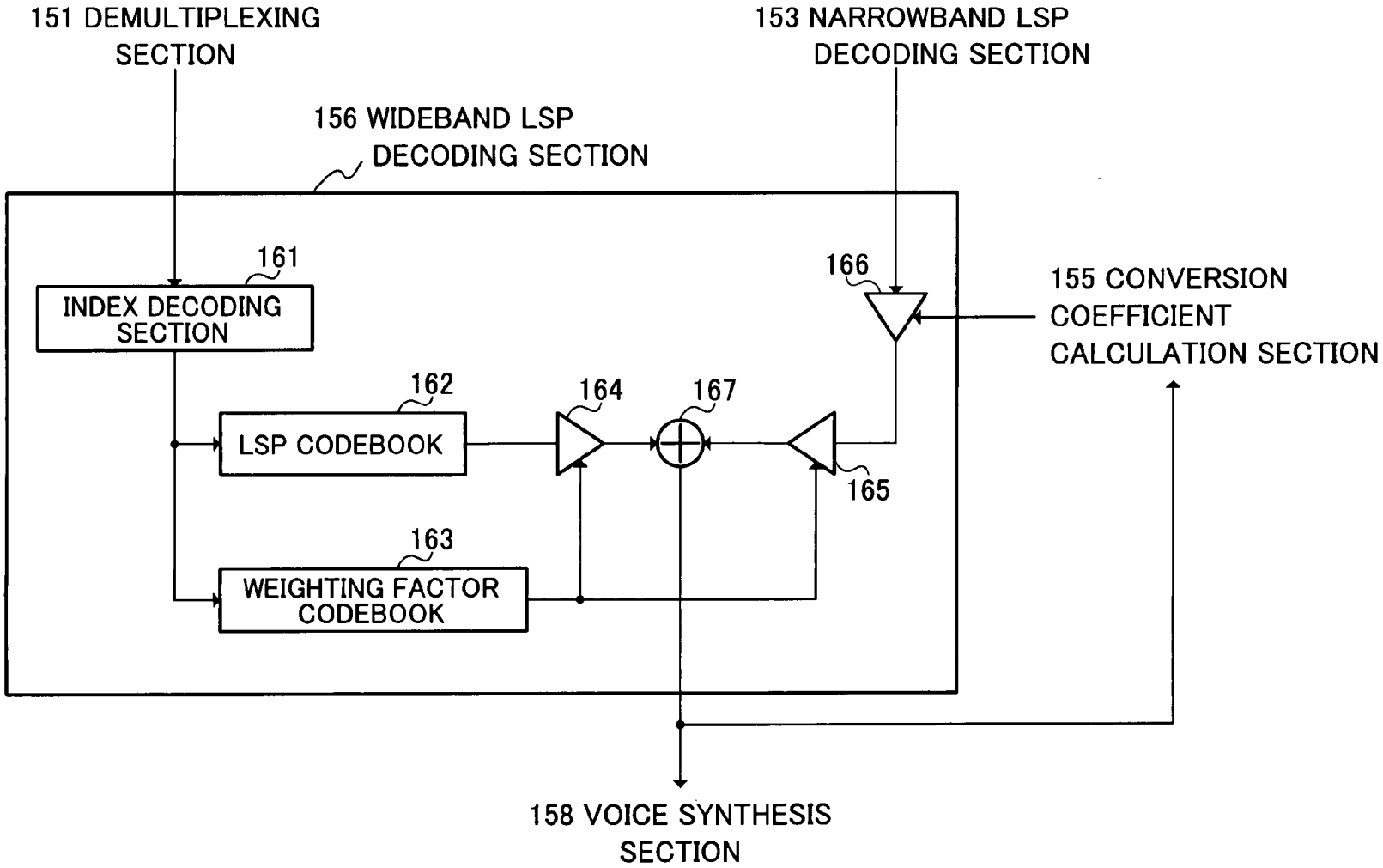
FIG. 8 is a block diagram showing the main configuration inside a wideband LSP decoding section according to Embodiment 1.

FIG. 8 is a block diagram showing the main configuration inside above-described wideband LSP decoding section 156.

This wideband LSP decoding section 156 is provided with: index decoding section 161; LSP codebook 162; weighting factor codebook 163; amplifiers 164 to 166; and adder 167.

Index decoding section 161 acquires the encoded information of wideband LSP from demultiplexing section 151, decodes index information for LSP codebook 162 and for weighting factor codebook 163 and outputs the index information to the codebooks.

LSP codebook 162 acquires the LSP codebook index from index decoding section 161, extracts the LSP vector specified by this index from the codebook and outputs the LSP vector to amplifier 164. When the codebook has a split type or a multi-stage configuration, the LSP codebook 162 extracts specified vectors from a plurality of sub codebooks and generates an LSP vector.

Weighting factor codebook 163 acquires the weighting factor codebook index from index decoding section 161, extracts the weighting factor set specified by this index from the codebook and outputs a coefficient sub set (consisting of the coefficient by which each order element of the LSP vector is multiplied) for amplifier 164 (for the LSP codebook) from the extracted coefficient set to amplifier 164, and a coefficient subset (consisting of the coefficient by which each order element of the predicted wideband LSP vector is multiplied) for amplifier 165 (for narrowband LSP) to amplifier 165.

Amplifier 164 multiplies the LSP vector input from LSP codebook 162 by the weighting factor for amplifier 164 input from weighting factor codebook 163 and outputs the result to adder 167.

Amplifier 165 multiplies the vector of wideband LSP converted from quantized narrowband LSP input from amplifier 166 by the weighting factor for amplifier 165 input from weighting factor codebook 163 and outputs the result to adder 167.

Adder 167 calculates the sum of the LSP vectors input from amplifier 164 and amplifier 165 and outputs the sum to voice synthesis section (for the wideband signal) 158 and conversion coefficient calculation section 155 as a quantization (or decoded) wideband LSP parameter. When the LSP parameter output as the quantized wideband LSP parameter does not meet a stability condition, that is, when the nth-order LSP is smaller than one of the 0th- to the (n−1) th-order LSP (when the value of LSP does not increase in ascending order of the order), an operation is added so as to meet the stability condition of the LSP. Even when the interval between neighboring quantized LSPs is smaller than a predetermined interval, an operation is performed so that the interval can be equal to or greater than the predetermined interval.

The internal configuration of conversion coefficient calculation section 155 shown in FIG. 7 is basically the same as conversion coefficient calculation section 109 shown in FIG. 6. Therefore a detailed explanation will be omitted. This configuration differs from conversion coefficient calculation section 109 shown in FIG. 6 only in that the input to delayer 131 in this conversion coefficient calculation section 155 is performed from narrowband LSP decoding section 153, the input to delayer 132 is performed from wideband LSP decoding section 156 and the output of smoothing section 135 is performed to wideband LSP decoding section 156.

The scalable decoding apparatus according to this embodiment has been explained in detail so far.

In this way, according to this embodiment, conversion coefficient calculation section 155 obtains an approximate value of an ideal conversion coefficient in the past frame using the encoded narrowband and wideband LSP parameters in the past frame (for example, a last frame) and determines a set of conversion coefficients from the quantized narrowband LSP in the current frame to wideband LSP based on this approximate value. More specifically, the approximate value of the ideal conversion coefficient is obtained by dividing the quantized wideband LSP in the past frame by the quantized narrowband LSP in the same frame. In other words, when the wideband LSP parameter is estimated from the narrowband LSP parameter by multiplying the narrowband LSP parameter by conversion coefficient $X_n(i)$, a set of conversion coefficients is adaptively determined per frame using the relationship between the narrowband LSP parameter and the wideband LSP parameter in the past. Therefore, the conversion coefficient changes over time. By employing this configuration, it is possible to improve prediction accuracy when predicting wideband LSP from narrowband LSP.

Furthermore, in the above configuration, the above-described conversion coefficient can be calculated only from the narrowband and the wideband LSP parameter quantized in the past frame, so that, for example, the decoding side need not separately acquire information from the encoding side. That is, the encoding performance of the wideband LSP parameter can be improved without increasing the communication transmission rate.

Furthermore, in the above configuration, since the above-described conversion coefficient can be directly obtained from the narrowband and the wideband LSP parameters in the past frame through predetermined calculations, it is not necessary to hold a set of a plurality of conversion coefficients in a data table or the like beforehand.

Furthermore, in the above-described configuration, limiter 134 in conversion coefficient calculation section 155 places limits on the conversion coefficient so as to be, for example, within approximately 10% of the average value in order to prevent the calculated conversion coefficient from becoming an extreme value. For example, when the voice mode changes, for example, from a voiced mode to unvoiced mode or from an unvoiced mode to voiced mode, the LSP parameter substantially changes and the calculated conversion coefficient may also change and may not become a proper value. When the conversion coefficient substantially changes in a short time, prediction using the LSP ratio of the wideband/narrowband of the preceding frame does not function and rather acts to increase the error. Then, the LSP codebook tries to correct such an increased error, but storing a vector having such a large error in the codebook will result in increase an error when the prediction error is small. That is, since the relationship between the conversion coefficient and the LSP codebook falls into a kind of resonant condition, in order to avoid such a situation, it is necessary to make the configuration where both are balanced.

Therefore, according to this embodiment, a set of conversion coefficients is obtained first for all frames according to the above-described calculation expression, but an upper limit and lower limit are provided for the conversion coefficient and when the calculated conversion coefficient is not within this range, a correction is carried out so as to make the conversion coefficient within this range. By this means, the conversion coefficient to be actually used can take a value within a predetermined range, thereby guarantees the stationarity (or quasi-stationarity) of the conversion coefficient and avoids a resonant condition. By this means, the prediction ability to predict by the conversion coefficient may be limited and prediction errors may increase, but if the range is limited to the neighborhood of a "fixed value" when the conversion coefficient is set to the fixed value, the prediction error never far exceeds the case where the conversion coefficient is set to a fixed value, so that it is possible to respond to this on the LSP codebook side like the case where the conversion coefficient is set to a fixed value. An approximate value of the conversion coefficient can be obtained by dividing quantized wideband LSP in the last frame by the quantized narrowband LSP in the last frame, and the conversion coefficient used in the current frame is obtained by limiting the approximate value to the neighborhood (for example, a range of approximately 10% before and after or range of standard deviation of the conversion coefficient) of an average conversion coefficient.

Furthermore, in the above configuration, the above-described conversion coefficient is subjected to smoothing processing between analysis frames (between preceding and subsequent frames) so as to change slowly in terms of time. Therefore, the conversion coefficient changes slowly with respect to variations of the LSP parameter, and it is possible to prevent the conversion coefficient from becoming oversensitive to transmission path errors. Furthermore, since the value of the conversion coefficient is stable, the design of the corresponding LSP code vector codebook becomes easier. Since the predicted value of quantized LSP is expressed by the product of the conversion coefficient and the LSP code vector, when one parameter changes violently, the other parameter also changes violently and the mutual relationship falls into a divergent state (same as the above-described resonant condition), and it is therefore impossible to design a high performance codebook. By employing the above-described configuration, the SD performance can improved by 0.05 dB. This performance improvement may depend on the number of quantization bits and the frame length.

Although an example has been shown in this embodiment where no MA prediction type LSP coder is used, the present invention can also be applied to a case where an MA predictor is used. In such a case, the MA prediction coefficient is stored in weighting factor codebook 163 and the dimensional number of the weighting factor vector increases by an amount corresponding to the MA prediction order.

Furthermore, although the case has been explained in this embodiment where conversion coefficient calculation section 109 is provided with both limiter 134 and smoothing section 135, a configuration provided with only one of these two may also be employed.

Embodiment 2

According to Embodiment 1, when a calculated conversion coefficient changes substantially, by making a correction such that the conversion coefficient is within a constant range, prediction is made to be performed stably when predicting wideband LSP from narrowband LSP. This embodiment focuses on a quantized LSP parameter, observes changes in this quantized LSP parameter to thereby determine whether or not the LSP parameter is changing and switches between conversion coefficients used for conversion.

More specifically, this embodiment focuses on the narrowband LSP encoding section of the narrowband on the encoding side or the obtained quantized narrowband LSP parameter at the narrowband LSP decoding section on the decoding side, determines a case where this quantized narrowband LSP parameter does not change as a stationary mode and a case where the quantized narrowband LSP parameter changes as a non-stationary mode and uses an LSP codebook and a weighting factor codebook by switching between them according to this decision result of mode. That is, in the stationary mode, adaptive control is performed by calculating a set of conversion coefficients according to the above-described arithmetic expression (Expression 2) per frame, and, on the other hand, in the non-stationary mode, a set of conversion coefficients is set to a fixed value or a quasi-fixed value using above-described (Expression 3). Here, the "quasi-fixed value" means that a plurality of conversion coefficients are preset, and a set of conversion coefficients is switched according to the encoding result of a voice signal (i.e. according to sound quality, encoding error, etc.) That is, a plurality of conversion coefficient sets of fixed values are held, and one optimum type is selected and used at the time of quantization.

Hereinafter, this embodiment will be explained in detail with reference to the attached drawings.

The basic configuration of a scalable encoding apparatus according to Embodiment 2 of the present invention is the same as the scalable encoding apparatus according to Embodiment 1. Therefore, detailed explanation of the scalable encoding apparatus according to this embodiment will be omitted and conversion coefficient calculation section 109*a* and wideband LSP encoding section 107*a* that have different configurations will be explained in detail below. The same components are assigned the same reference numerals and their explanations will be omitted.

Figure 9:
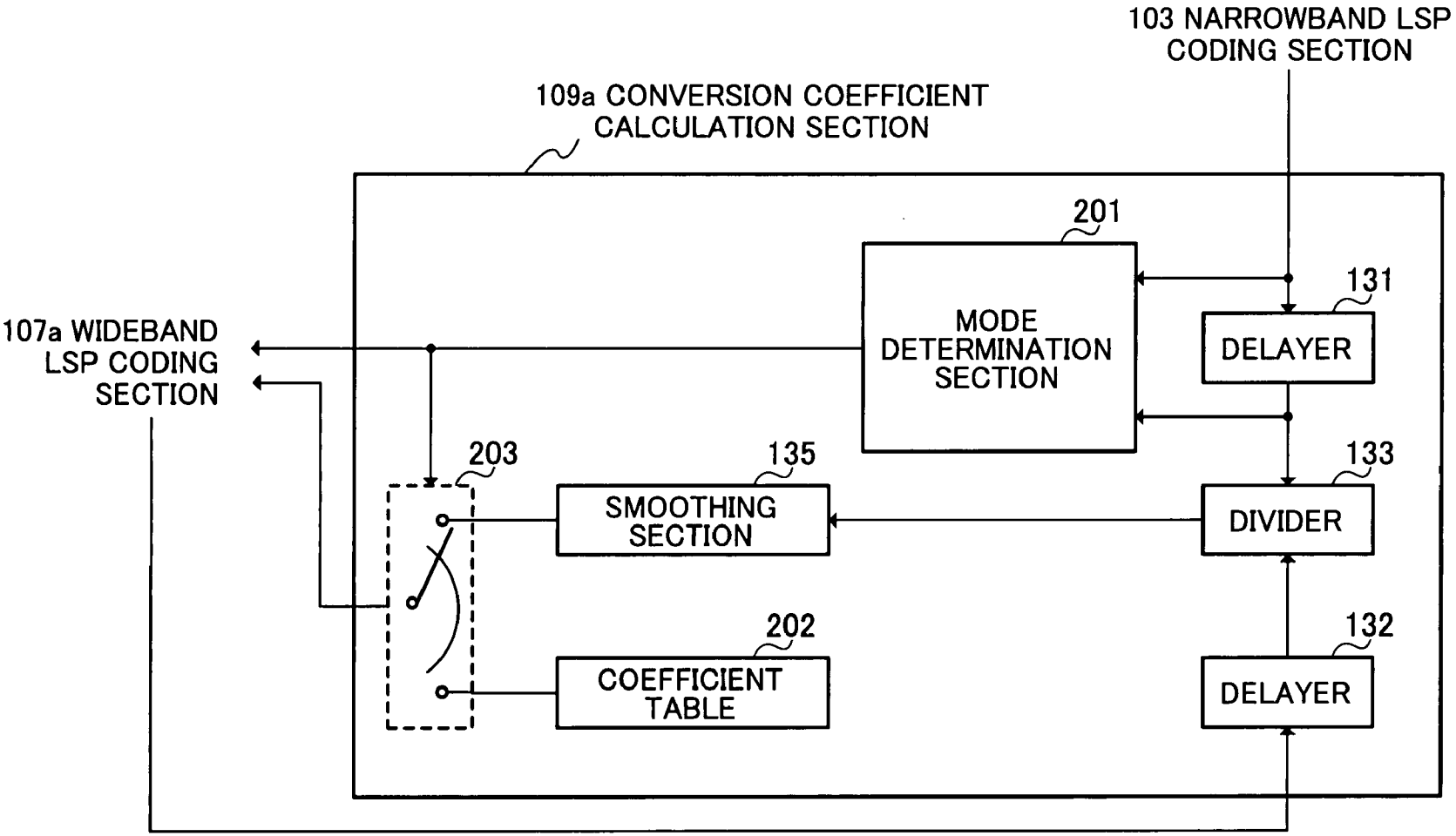
FIG. 9 is a block diagram showing the main configuration inside a conversion coefficient calculation section according to Embodiment 2.

FIG. 9 is a block diagram showing the main configuration inside conversion coefficient calculation section 109*a*.

This conversion coefficient calculation section 109*a* is provided with, instead of limiter 134, mode determination section 201 coefficient table 202 and changeover switch 203. Conversion coefficient calculation section 109*a* uses a calculated conversion coefficient and a set of conversion coefficients stored in a coefficient table beforehand by switching between them according to a mode determination result at mode determination section 201.

Mode determination section 201 calculates the distance (the amount of change) between the quantized narrowband LSP input from narrowband LSP encoding section 103 and narrowband LSP, which is quantized one processing unit time before, output from delayer 131, and determines whether the mode is a stationary mode or non-stationary mode based on the calculated distance. For example, a stationary mode is determined when the calculated distance is equal to or smaller than a preset threshold value, and a non-stationary mode is determined when the calculated distance exceeds the threshold value. The decision result is output to wideband LSP encoding section 107*a* and changeover switch 203. The calculated distance may be used for a threshold decision as is or may be smoothed among frames and then used for a threshold decision.

Changeover switch 203 outputs the conversion coefficient output from smoothing section 135 to wideband LSP encoding section 107*a* when the decision result at mode determination section 201 is a stationary mode. On the other hand, changeover switch 203 is switched so as to output the conversion coefficient stored in the coefficient table to wideband LSP encoding section 107*a* when the decision result at mode determination section 201 is a non-stationary mode.

When the LSP parameter shows a stationary value, the LSP parameter ratio of wideband/narrowband in the current frame approximates to the quantized LSP parameter ratio of the wideband/narrowband in the last frame, so that applying the quantization using (Expression 2) improves the prediction accuracy when predicting a wideband LSP parameter from a narrowband LSP parameter and improves quantization performance.

Figure 10:
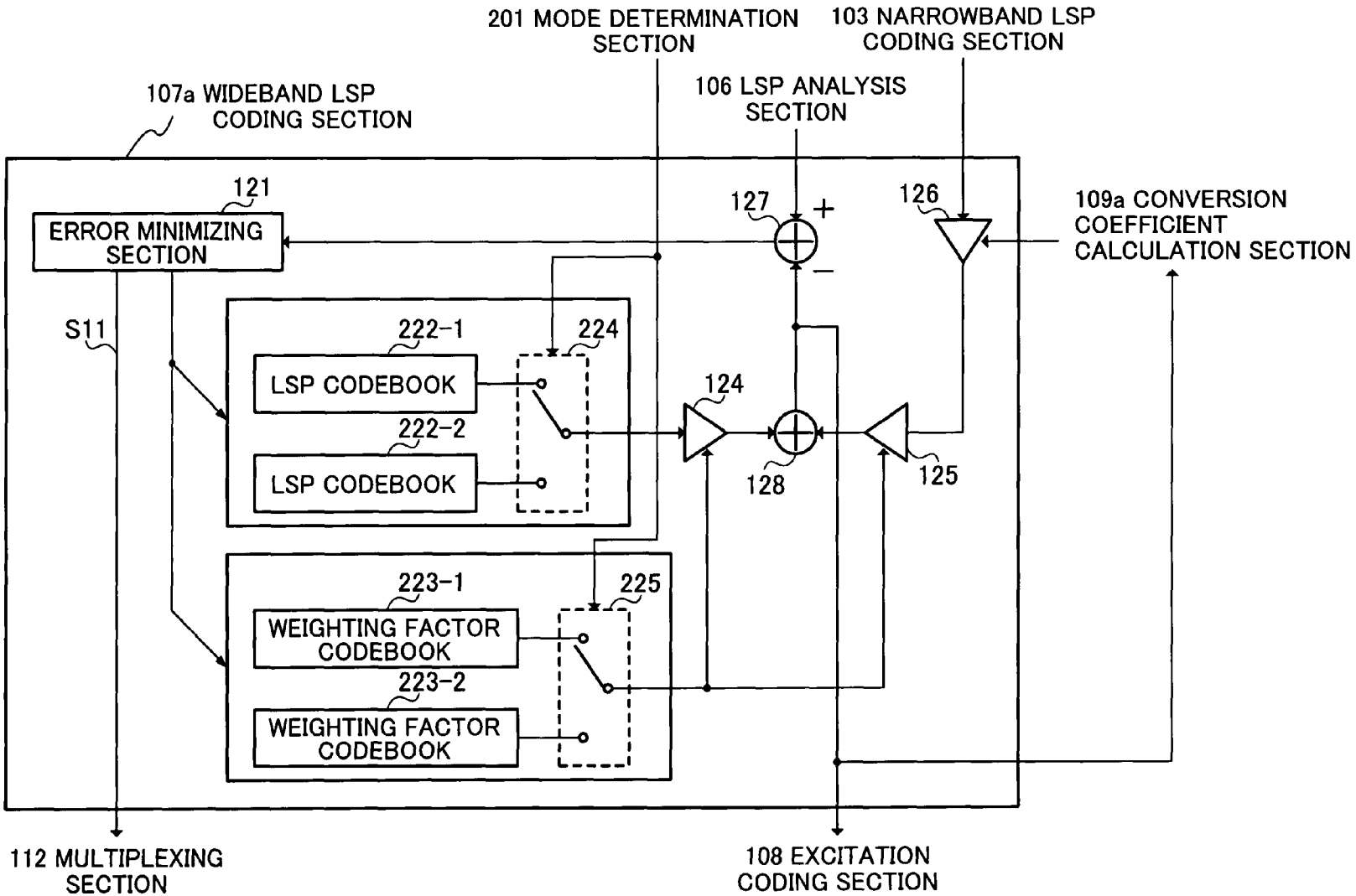
FIG. 10 is a block diagram showing the main configuration inside a wideband LSP encoding section according to Embodiment 2.

FIG. 10 is a block diagram showing the main configuration inside above-described wideband LSP encoding section 107*a*.

An LSP codebook and weighting factor codebook are composed of the same number of sub codebooks as the modes (here two, i.e. LSP codebooks 222-1 and 222-2 and weighting factor codebooks 223-1 and 223-2) and changeover switches 224 and 225 are configured so that each switch selects one sub codebook based on the mode information input from mode determination section 201.

The basic configuration of the scalable decoding apparatus according to Embodiment 2 of the present invention is also the same as the scalable decoding apparatus according to Embodiment 1. Therefore, detailed explanations will be omitted and conversion coefficient calculation section 155*a* and wideband LSP decoding section 156*a* that have different configurations will be explained below. The same components are assigned the same reference numerals and their explanations will be omitted.

The internal configuration of conversion coefficient calculation section 155*a* is basically the same as conversion coefficient calculation section 109*a* shown in FIG. 9. Therefore, detailed explanations will be omitted, but this configuration differs from conversion coefficient calculation section 109*a* shown in FIG. 9 in that the input to delayer 131 is performed from the narrowband LSP decoding section 153, the input to delayer 132 is performed from wideband LSP decoding section 156*a* and the output of smoothing section 135 is performed to wideband LSP decoding section 156*a*. Furthermore, suppose that the reference numeral for the mode determination section is, for convenience sake, 251 to distinguish it from mode determination section 201 on the encoding side.

Figure 11:
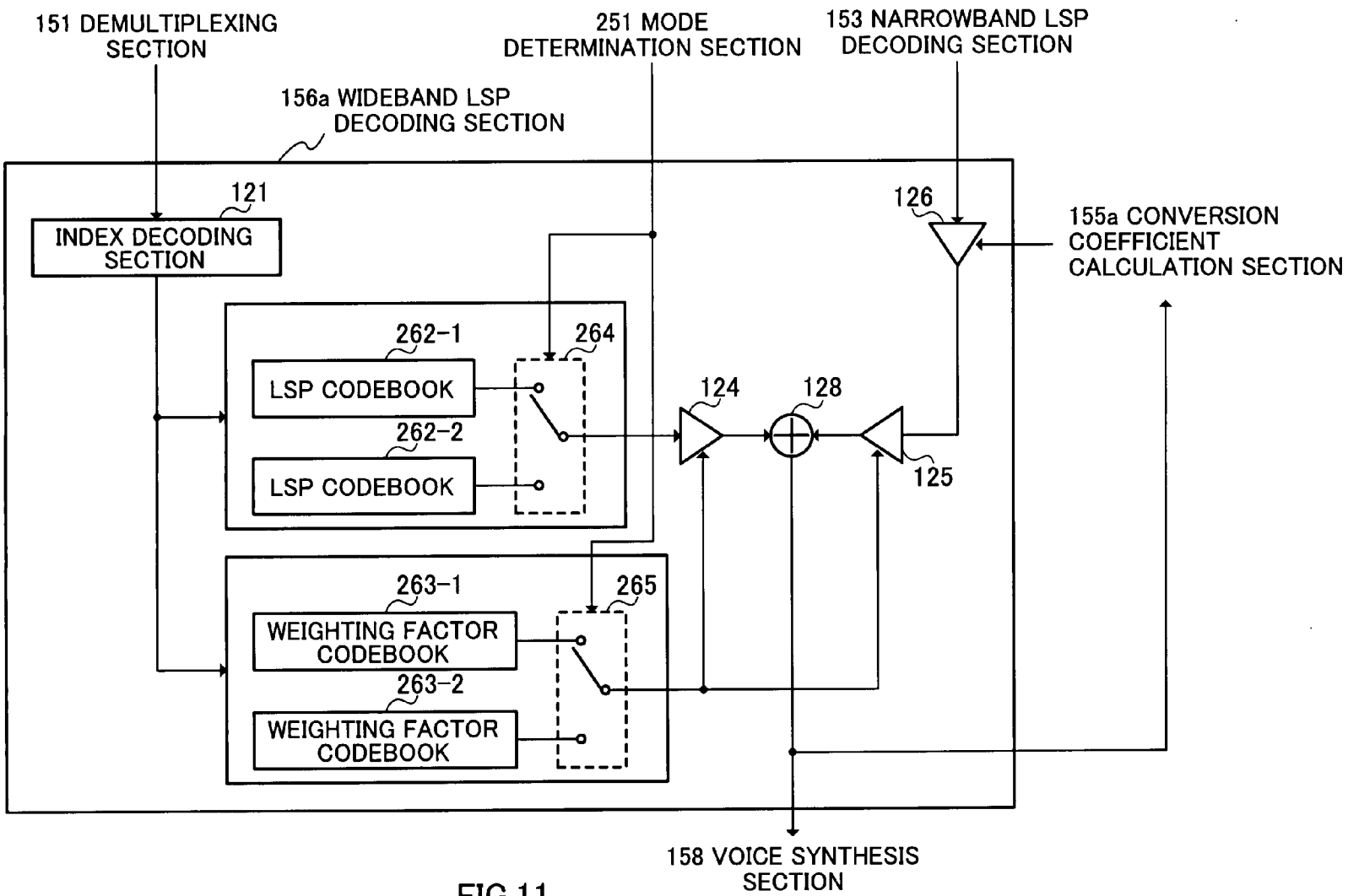
FIG. 11 is a block diagram showing the main configuration inside a wideband LSP decoding section according to Embodiment 2.

FIG. 11 is a block diagram showing the main configuration inside above-described wideband LSP decoding section 156*a*.

The LSP codebook and the weighting factor codebook are composed of the same number of sub codebooks as the modes (here two, i.e. LSP codebooks 262-1 and 262-2 and weighting factor codebooks 263-1 and 263-2) and changeover switches 264 and 265 are configured so that each switch selects one sub codebook based on the mode information input from mode determination section 251.

Thus, this embodiment determines stationarity of input unquantized wideband LSP or narrowband LSP quantized in the current frame and uses the selectively calculated conversion coefficient only when the frame is determined as a stationary frame (i.e. in the case where variation among the frames is small). When the frame is determined as a non-stationary frame (i.e. in the case where variation among the frames is large), this embodiment uses the conversion coefficient separately stored in the table. In other words, the calculated conversion coefficient and the conversion coefficient designed and stored in the table beforehand are switched based on the stationarity of the LSP parameter.

By employing the above-described configuration, it is possible to improve the prediction accuracy when predicting wideband LSP from narrowband LSP. Furthermore, since the variation of the LSP parameter is determined using the quantized LSP parameter after the encoding, the decoding side can determine the variation of the LSP parameter even if mode information is not transmitted from the encoding side. Mode information is not necessarily transmitted from the encoding side, and therefore the communication system resources are not consumed.

Embodiment 3

Embodiment 2 observes variations of the quantized narrowband LSP parameter and determines the degree of variations of the LSP parameter (mode determination). However, even when the quantized narrowband LSP parameter is in a stationary condition, the quantized wideband LSP parameter may be changing.

The current frame is decoded on the decoding side based on the mode determination result in the past, and, therefore, when the mode determination in the past is wrong, the error propagates to the subsequent processing according to the method of Embodiment 2.

Therefore, in this embodiment, the encoding side installs a new mode determination section that makes a mode determination using a wideband LSP parameter and transmits the obtained mode determination result to the decoding side. The decoding side installs a new mode decoding section that decodes this mode determination result.

Hereinafter, this embodiment will be explained in detail with reference to the attached drawings.

Figure 12:
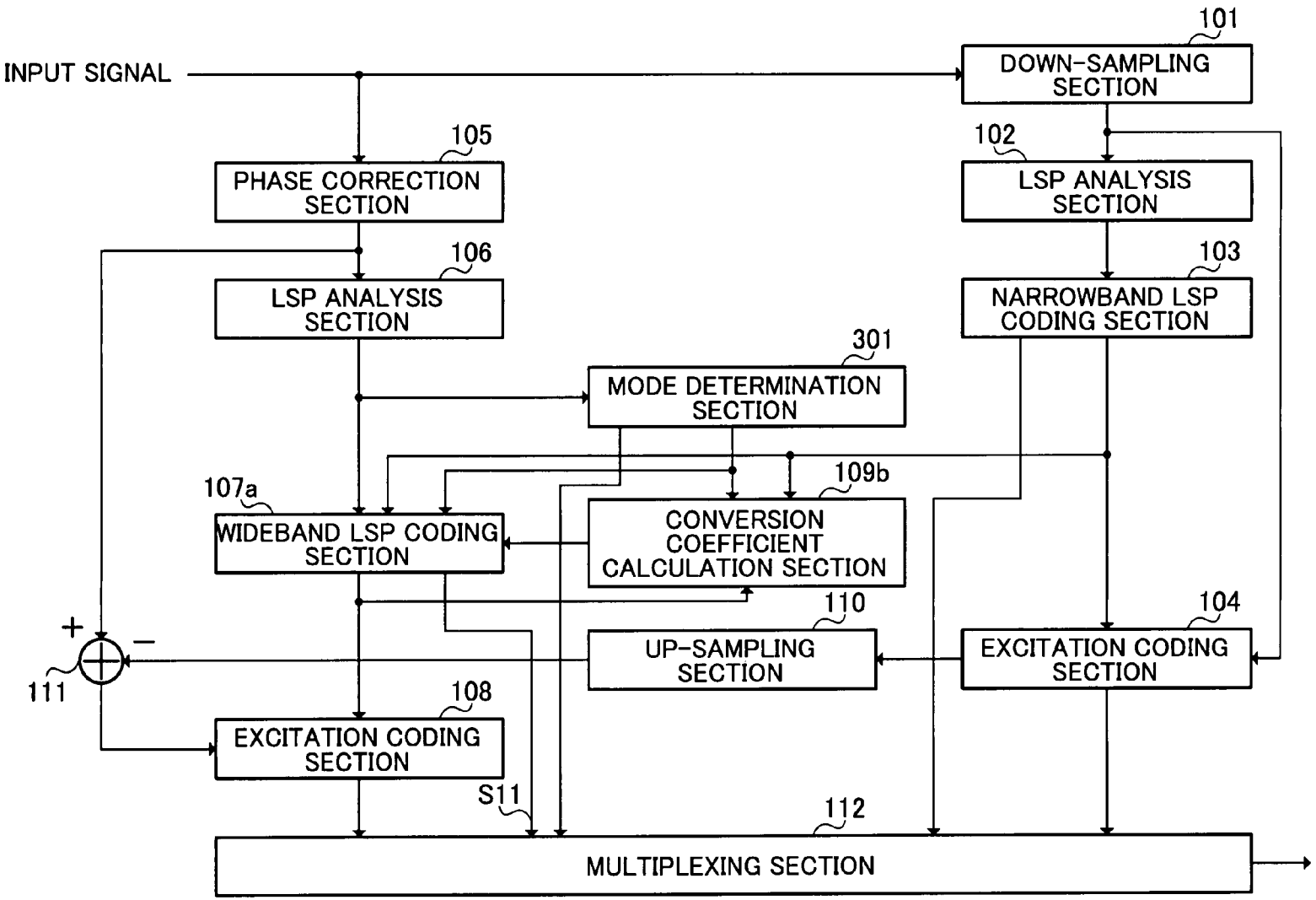
FIG. 12 is a block diagram showing the main configuration of a scalable encoding apparatus according to Embodiment 3.

FIG. 12 is a block diagram showing the main configuration of a scalable encoding apparatus according to Embodiment 3 of the present invention. This scalable encoding apparatus has a basic configuration same as the scalable encoding apparatus (see FIG. 4) shown in Embodiment 1 and the same components are assigned the same reference numerals and their explanations will be omitted.

Mode determination section 301 basically operates in a manner same as mode determination section 201 (251) shown in Embodiment 2. That is, mode determination section 301 calculates the distance between an LSP parameter delayed by one processing unit time and a current LSP parameter and determines a stationary mode when this distance is equal to or smaller than a preset threshold and determines a non-stationary mode when this distance exceeds the threshold. However, this embodiment differs from Embodiment 2 in that a wideband LSP parameter output from LSP analysis section (for the wideband signal) 106 is used as the input information. The decision result of mode determination section 301 is output to conversion coefficient calculation section 109*b* and wideband LSP encoding section 107*a* and encoded information of the mode information is output to multiplexing section 112. Wideband LSP encoding section 107*a* has already been explained in Embodiment 2.

In this way, mode determination section 301 determines stationary/non-stationary using not encoded information (e.g. quantized LSP parameter) but the unquantized wideband LSP parameter, and therefore it is also applicable to a signal that has a large variation only in the high-frequency components of the wideband signal.

Furthermore, mode determination section 301 multiplexes the obtained mode result with the other encoding parameters and transmits the multiplexing result to the decoding side. Since mode determination section 301 transmits the mode information to the decoding side, even if the decoding side makes a mistake in the decision of mode information once, the next mode information is transmitted in the subsequent frame, and therefore the influence of the decision error in the preceding frame does not propagate and the transmission path error tolerance thereby improves.

Figure 13:
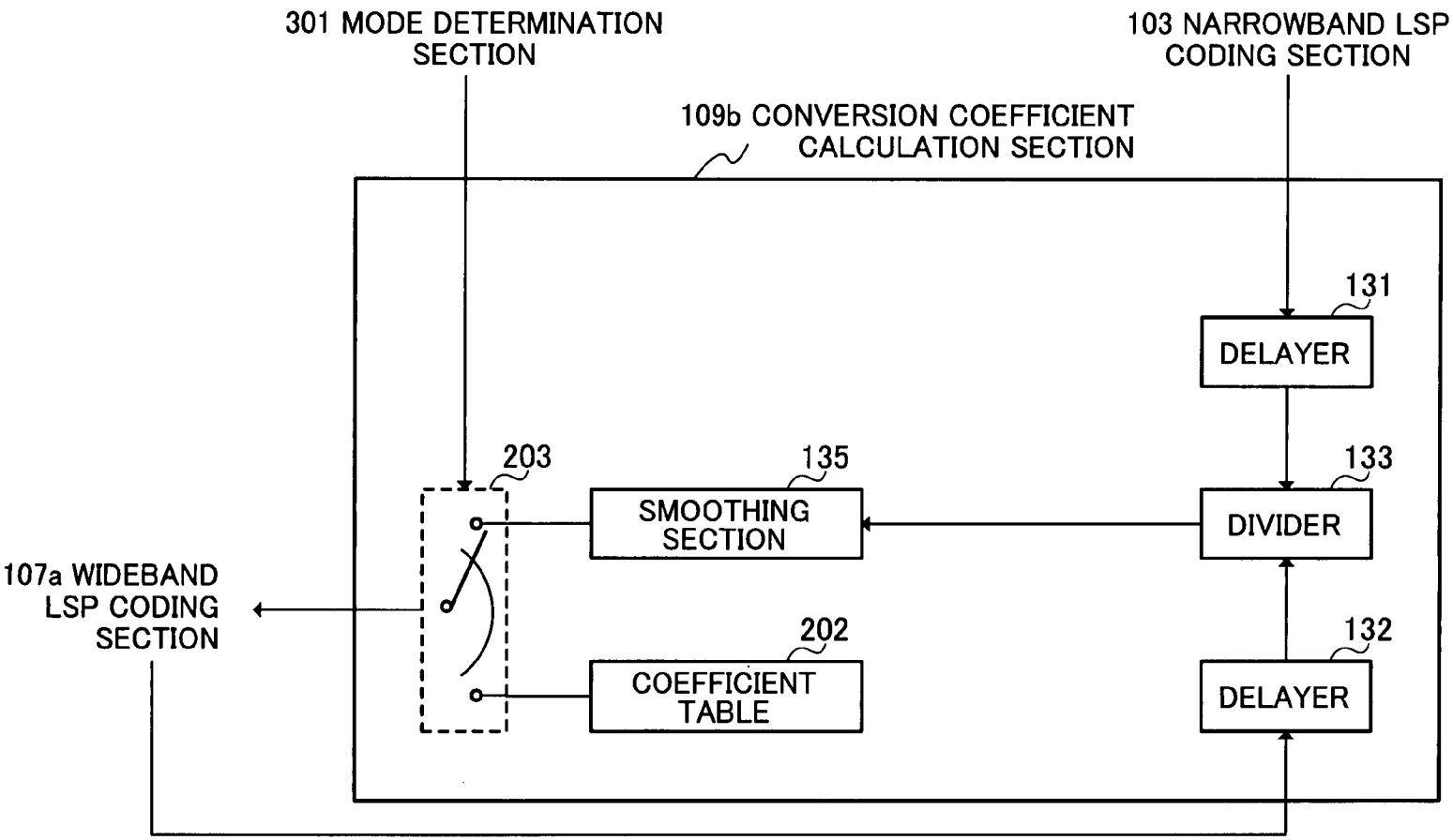
FIG. 13 is a block diagram showing the main configuration inside a conversion coefficient calculation section according to Embodiment 3.

FIG. 13 is a block diagram showing the main configuration inside conversion coefficient calculation section 109*b*. This conversion coefficient calculation section 109*b* has a basic configuration same as conversion coefficient calculation section 109*a* of Embodiment 2 shown in the FIG. 9 and only different parts will be explained below.

Conversion coefficient calculation section 109*b* is provided with no mode determination section and inputs only mode determination results from outside. Then, conversion coefficient calculation section 109*b* changes the changeover switch according to the input mode determination result. More specifically, in the stationary mode, changeover switch 203 is switched so that a set of conversion coefficients output from smoothing section 135 is output to wideband LSP encoding section 107*a*. In the non-stationary mode, changeover switch 203 is switched so that the conversion coefficient designed by offline learning beforehand or the like is output from coefficient table 202 to wideband LSP encoding section 107*a*.

Figure 14:
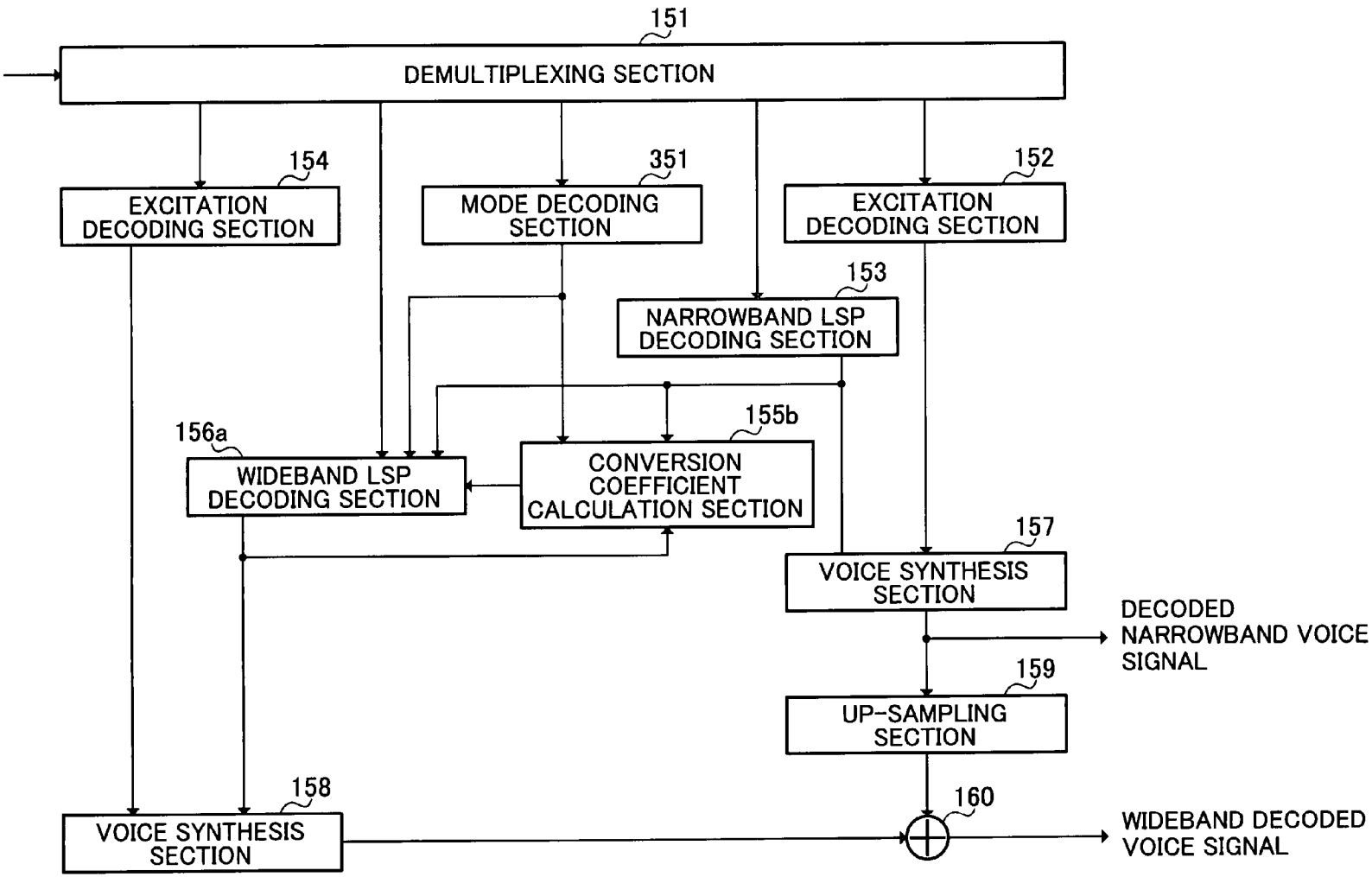
FIG. 14 is a block diagram showing the main configuration of a scalable decoding apparatus according to Embodiment 3.

FIG. 14 is a block diagram showing the main configuration of the scalable decoding apparatus according to Embodiment 3 of the present invention.

This scalable decoding apparatus also has a basic configuration same as the scalable decoding apparatus (see FIG. 7) shown in Embodiment 1 and the same components are assigned the same reference numerals and their explanations will be omitted. This configuration differs from the scalable decoding apparatus shown in Embodiment 1 in that new mode decoding section 351 is added and the output information of mode determination section 301 of the scalable encoding apparatus according to this embodiment is decoded and the decoded information is output to conversion coefficient calculation section 155*b* and wideband LSP decoding section 156*a*. Conversion coefficient calculation section 155*b* also has a basic configuration same as conversion coefficient calculation section 109*b* (see FIG. 13) on the encoding side.

This embodiment has explained the case where a mode determination is made based on a time variation of the LSP parameter, but it is also possible to make a mode determination based on the conversion gain of the conversion coefficient. The conversion gain of this conversion coefficient indicates the degree of closeness of the ratio of "quantized wideband LSP/quantized narrowband LSP" in the preceding frame to the ratio of "input wideband LSP/quantized narrowband LSP" in the current frame.

Embodiment 4

A feature of this embodiment is to make a mode determination inside the narrowband LSP encoding section on the encoding side or the narrowband LSP encoding section on the decoding side without the encoding side transmitting mode information to the decoding side.

Figure 15:
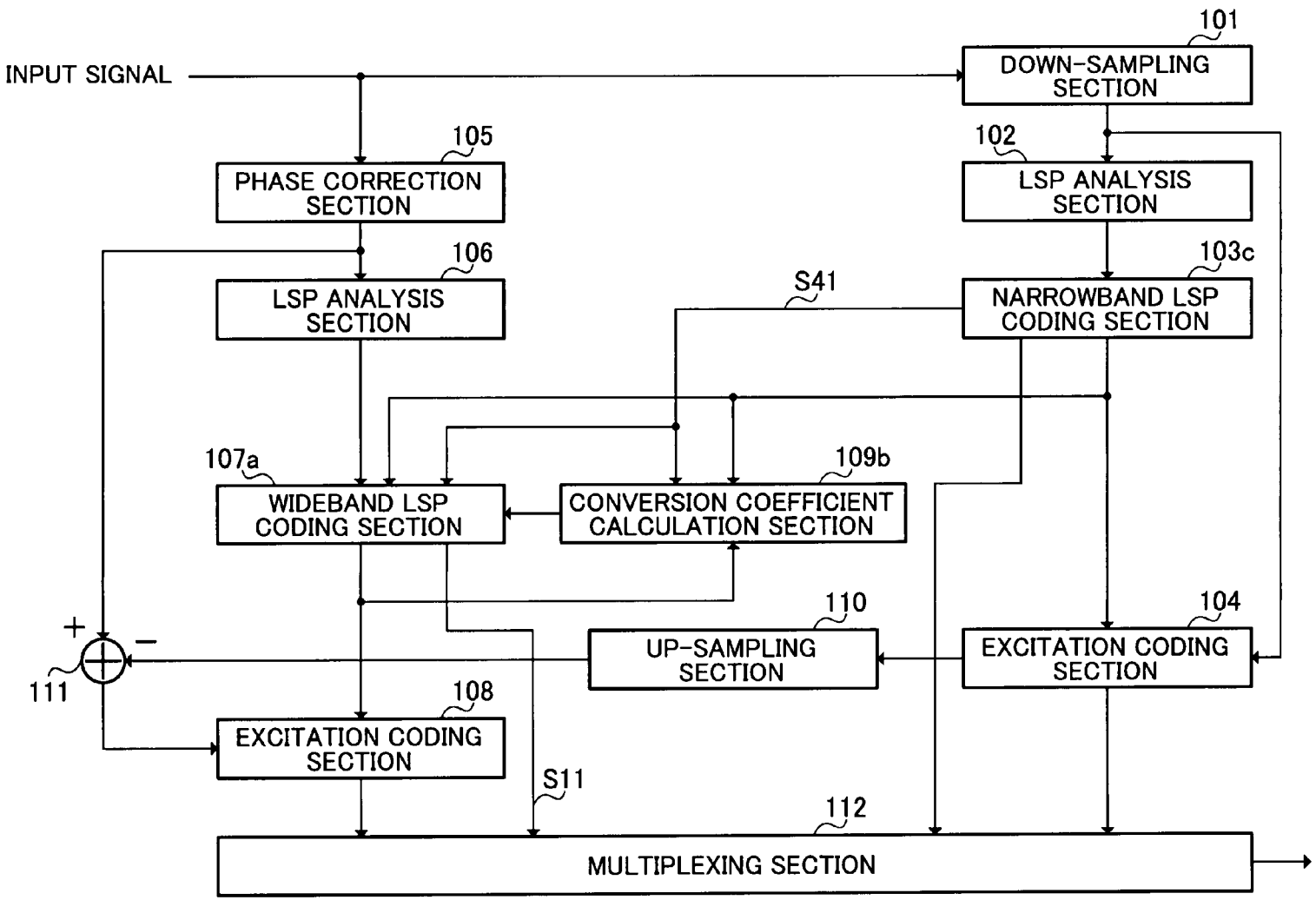
FIG. 15 is a block diagram showing the main configuration of a scalable encoding apparatus according to Embodiment 4.

FIG. 15 is a block diagram showing the main configuration of a scalable encoding apparatus according to Embodiment 4 of the present invention. This scalable encoding apparatus has a basic configuration same as the scalable encoding apparatus (see FIG. 12) shown in Embodiment 3 and the same components are assigned the same reference numerals and their explanations will be omitted.

In the scalable encoding apparatus according to this embodiment, narrowband LSP encoding section 103*c* performs multi-mode encoding, and mode switching of conversion coefficient calculation section 109*b* and mode switching of wideband LSP encoding section 107*a* are performed using the mode information (S41).

The technology whereby the narrowband LSP encoding section switches between modes with the stationarity of LSP is described, for example, in T. Eriksson, J. Linden, and J. Skoglund, "Exploiting interframe correlation in spectral quantization-A study of different memory VQ schemes," Proc. IEEE ICASSP-96, pp. 765-768, 1996. This document proposes a technique called "Safety-net VQ" which switches between a mode using inter-frame prediction and a mode not using such prediction to support both frames having a strong inter-frame correlation (high stationarity) and other frames. Using such a quantizer for a narrowband LSP encoding section allows the mode information to be used as the mode switching information of the wideband LSP encoding section and conversion coefficient calculation section.

Figure 16:
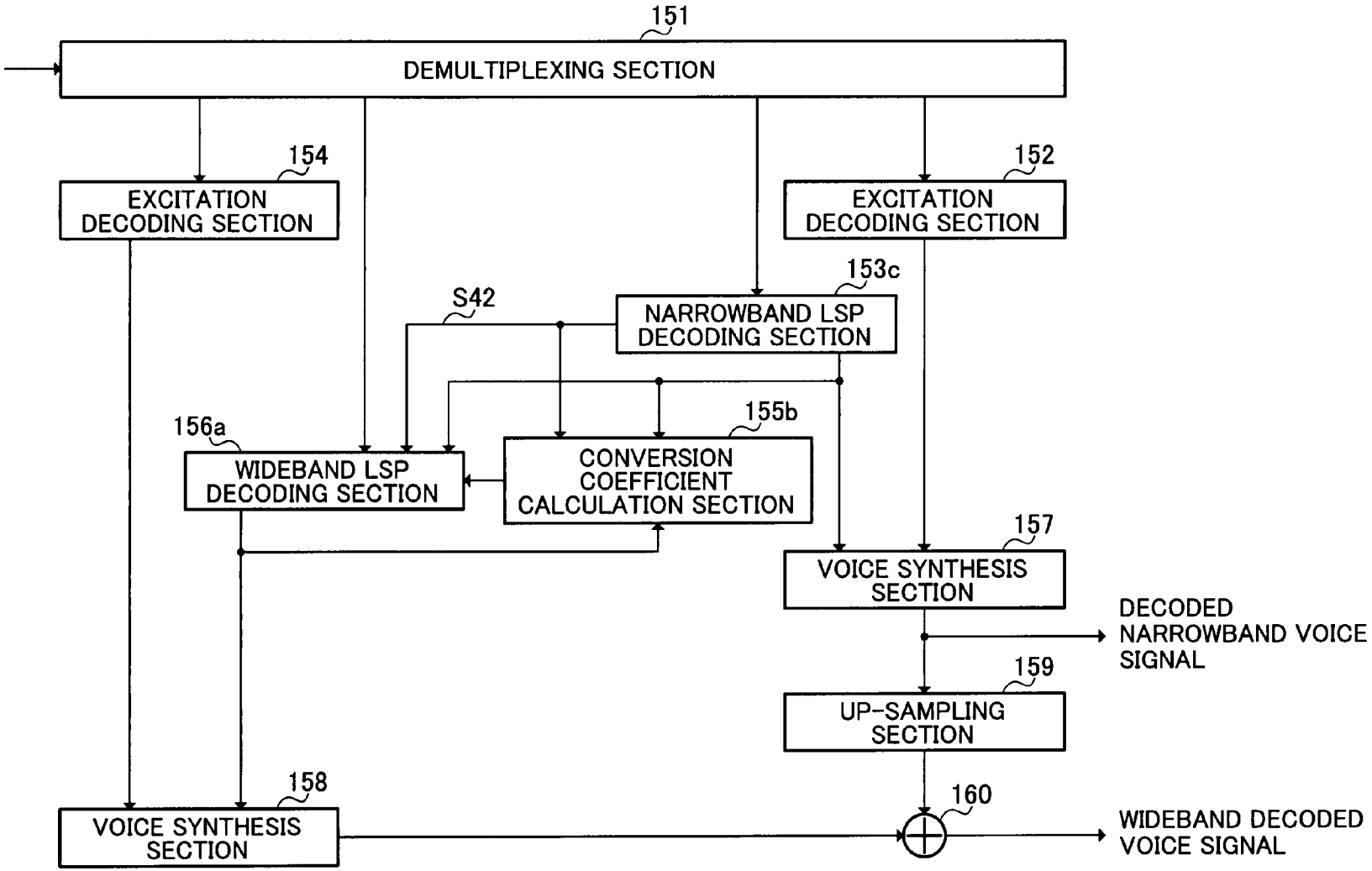
FIG. 16 is a block diagram showing the main configuration of a scalable decoding apparatus according to Embodiment 4.

FIG. 16 is a block diagram showing the main configuration of a scalable decoding apparatus according to Embodiment 4 of the present invention. This scalable decoding apparatus also has a basic configuration same as the scalable decoding apparatus (see FIG. 14) shown in Embodiment 3 and the same components are assigned the same reference numerals and their explanations will be omitted.

In the scalable decoding apparatus according to this embodiment, narrowband LSP decoding section 153*c* is provided with a mode information decoding function. That is, narrowband LSP decoding section 153*c* performs multi-mode decoding and outputs the mode information (S42) to conversion coefficient calculation section 155*b* and wideband LSP decoding section 156*a*. Conversion coefficient calculation section 155*b* and wideband LSP decoding section 156*a* perform mode switching using the mode information (S42) input from narrowband LSP decoding section 153*c*.

In this way, according to this embodiment, the mode of wideband LSP coding is changed using the mode information of the narrowband LSP encoded information, and therefore it is possible to perform mode switching of the wideband LSP coding section, wideband LSP decoding section or the conversion coefficient section without additional bits for encoding the mode switching information. Furthermore, since mode information is transmitted, it is possible to prevent influences of errors from propagating to the subsequent frames even when transmission path errors occur.

Embodiment 5

In Embodiment 3, a mode determination is made before LSP quantization and codebooks to be searched for are switched based on this mode determination result. That is, a mode determination is made in an open loop manner before performing the actual LSP quantization, and, therefore, a mode at which a quantization error is minimized may not always be selected. For example, a mode determination according to Embodiment 3 is performed based on the LSP parameter before its quantization, but even if the LSP parameter before quantization has changed, the LSP parameter after quantization may not always change or even if the LSP parameter before its quantization is stationary, the LSP parameter after its quantization may not always be stationary. Furthermore, even if LSP parameters in some orders are stationary, if LSP parameters in the other orders are non-stationary, when changes in all orders are taken, the LSP parameters may be determined to be stationary. In this way, when a mode determination is made in an open loop, it is difficult to select a mode at which a quantization error is surely minimized.

Therefore, this embodiment makes a mode determination in a closed loop manner instead of determining a mode in an open loop manner. That is, when there are two or more modes with regard to stationary mode/non-stationary mode, a codebook search is actually performed with regard to all modes, and a mode at which a quantization error (i.e. quantization distortion) is minimized is selected based on this result. Further, in other words, the wideband LSP encoding section actually performs quantization using two modes: a mode in which a set of conversion coefficients calculated is used for quantizing a wideband LSP; and a mode in which a predetermined fixed conversion coefficient is used for quantizing a wideband LSP, and selects the quantization result by the mode providing smaller quantization errors as the final quantization result.

Hereinafter, this embodiment will be explained in detail with reference to the attached drawings.

Figure 17:
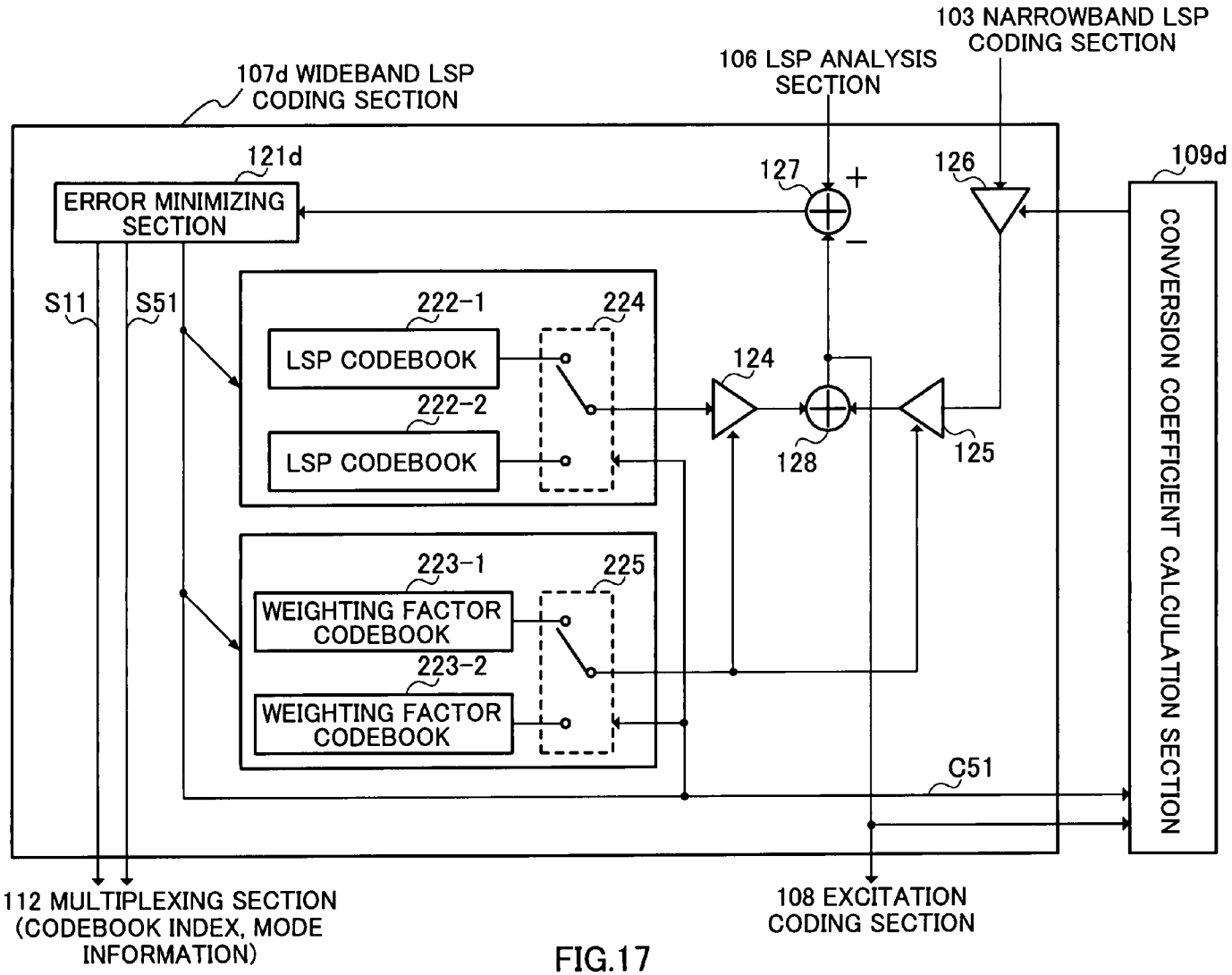
FIG. 17 is a block diagram showing the main configuration of a wideband LSP encoding section according to Embodiment 5.

FIG. 17 is a block diagram showing the main configuration of wideband LSP encoding section 107*d* according to Embodiment 5 of the present invention. This wideband LSP encoding section 107*d* has a basic configuration same as wideband LSP encoding section 107*a* (see FIG. 10) shown in Embodiment 2 and the same components are assigned same reference numerals and their explanations will be omitted.

Error minimizing section 121*d* performs a codebook search with regard to all modes, selects an LSP vector and a weighting factor vector at which a quantization error is minimized among codebooks in all the modes, from LSP codebooks 222-1 and 222-2 and weighting factor codebooks 223-1 and 223-2, codes corresponding indices and outputs the result to multiplexing section 112 (S11). At this time, the selected LSP vector and the mode information on the generated weighting factor vector (information indicating the codebook from which mode the vectors have been selected) S51 are also output to multiplexing section 112.

Figure 18:
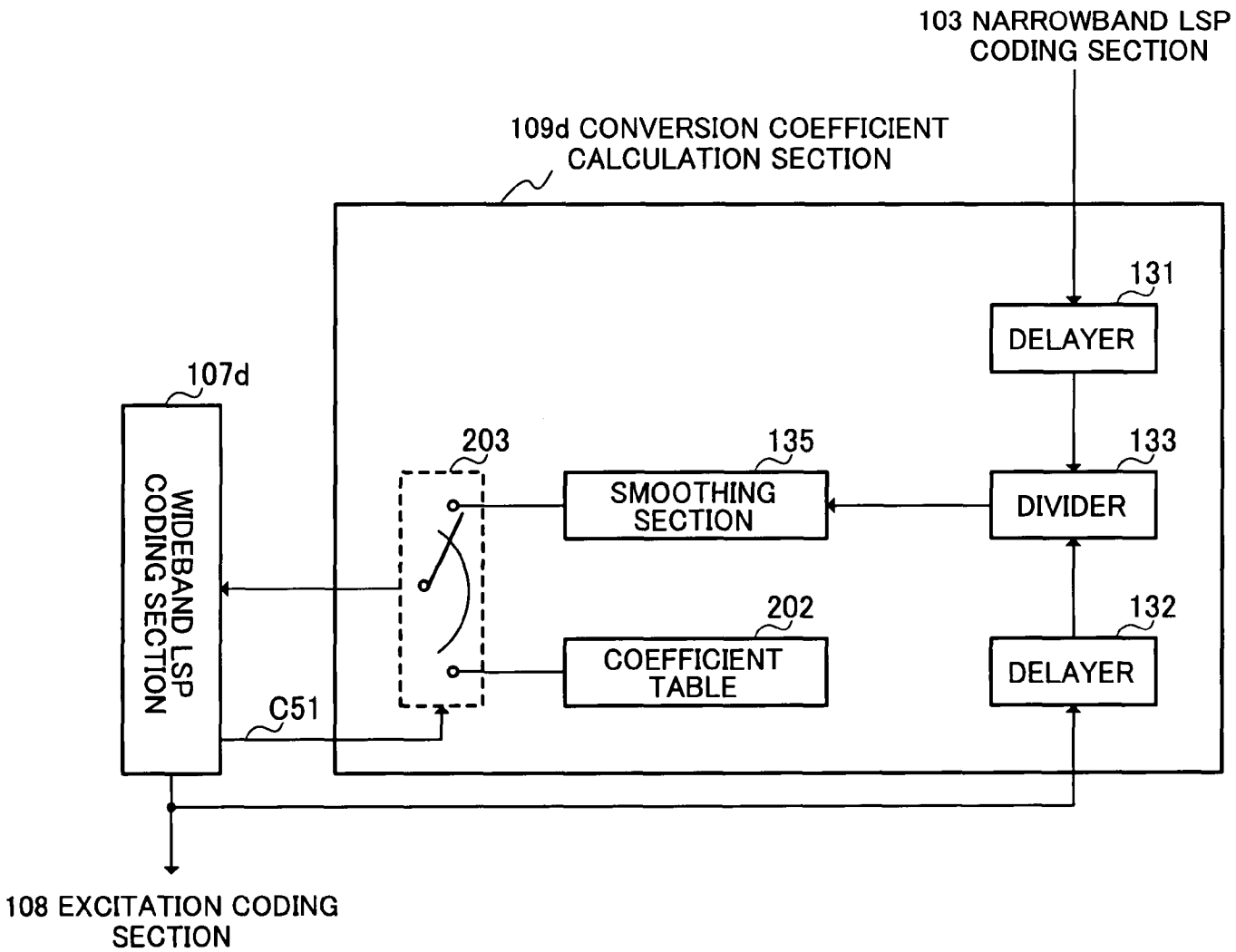
FIG. 18 is a block diagram showing the main configuration of a conversion coefficient calculation section according to Embodiment 5.

FIG. 18 is a block diagram showing the main configuration of conversion coefficient calculation section 109*d* according to Embodiment 5 of the present invention. This conversion coefficient calculation section 109*d* has a basic configuration same as conversion coefficient calculation section 109*a* shown in Embodiment 2 (see FIG. 9) and the same components are assigned the same reference numerals and their explanations will be omitted.

Conversion coefficient calculation section 109*d* switches between prediction coefficients to be used according to control signal C51 output from error minimizing section 121*d* in wideband LSP encoding section 107*d*. That is, conversion coefficient calculation section 109*d* changes whether quantized LSP should be expressed by (Expression 2) or by (Expression 3) according to control signal C51.

In this way, conversion coefficient calculation section 109*d* actually performs quantization and determines whether or not to perform quantization using (Expression 3) according to this quantization result. Therefore, the mode using (Expression 3) is selected only for frames whose performance is expected to be surely improved through quantization according to (Expression 3), so that high prediction performance can be obtained.

Furthermore, according to this embodiment, quantization according to (Expression 3) is performed only on frames for which the ratio of the quantized wideband/narrowband LSP parameters in the preceding frame is close to the ratio of the wideband/narrowband LSP parameter in the current frame. That is, the quantization according to (Expression 3) is performed not on the frames whose wideband/narrowband LSP parameter is determined to be stationary but on the frames whose ratio of the wideband/narrowband LSP parameters is determined to be stationary. Therefore, the error tolerance can be improved. This is because, in a period where the quantization mode according to (Expression 3) continues to be selected, the ratio of the quantized wideband/narrowband LSP parameters is substantially guaranteed to be stationary. Therefore, for example, when the last frame is wrong, it is possible to make approximations using the ratio of the quantized wideband/narrowband LSP parameter in a frame of two or more frames before. On the other hand, when a mode determination is made based on whether or not the LSP parameter is stationary, even if the LSP parameter is stationary, the quantized LSP parameter ratio of the wideband/narrowband may not always be stationary. Therefore, when the last frame is wrong, there is a possibility that the quantized LSP parameter ratio of the wideband/narrowband in a frame of two frames before which is likely to be non-stationary may be used as the approximate value instead of this frame. In this case, the obtained decoding result is likely to be significantly different from the decoding result in the error-free condition.

Furthermore, according to this embodiment, when the last frame is wrong, the mode according to (Expression 2) is selected, predictive encoding is reset in this stage, so that it is possible to prevent errors from propagating to the subsequent frames and improve error tolerance.

Figure 19:
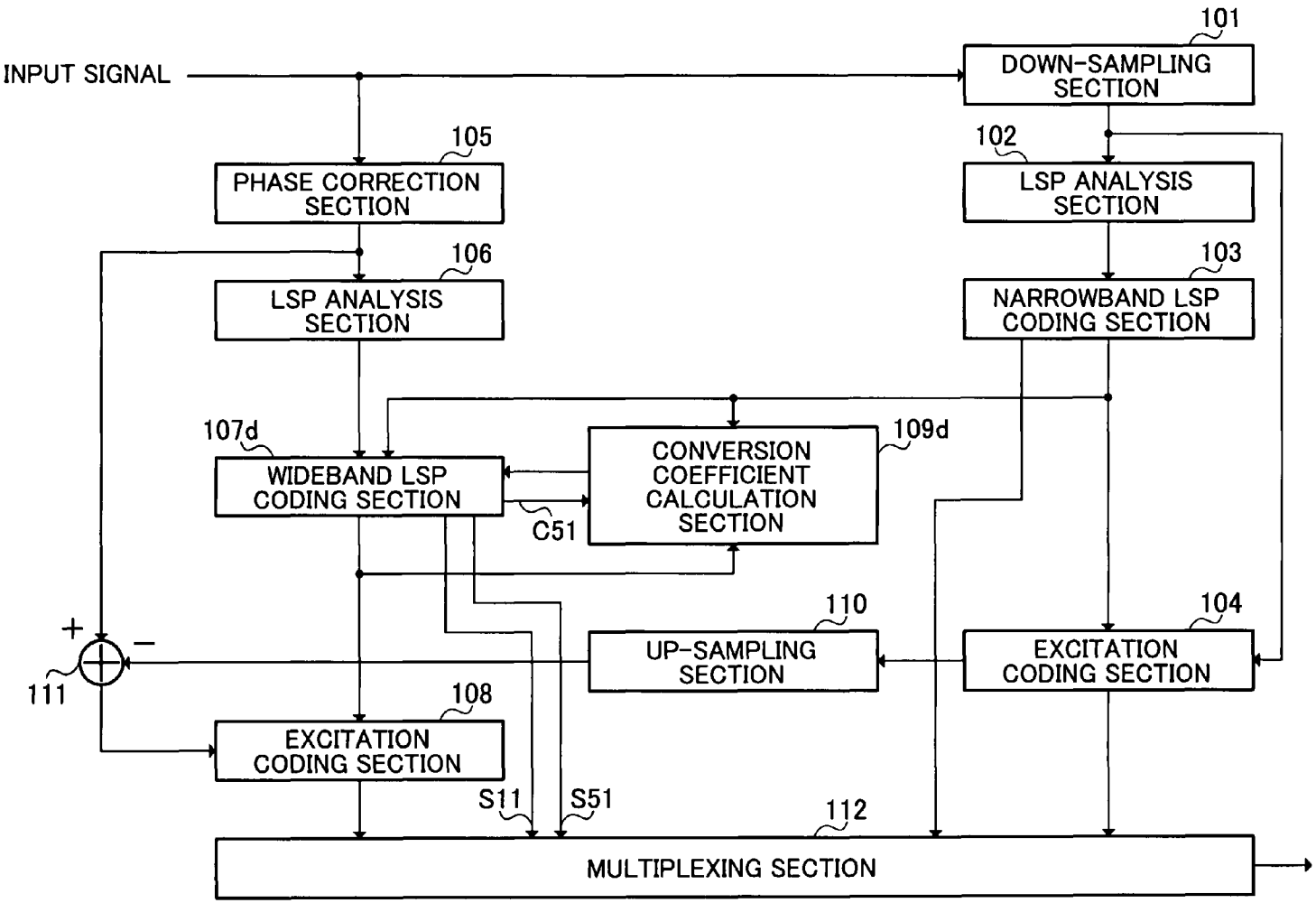
FIG. 19 is a block diagram showing the main configuration of a scalable encoding apparatus according to Embodiment 5.

FIG. 19 is a block diagram showing the main configuration of a scalable encoding apparatus provided with above-described wideband LSP encoding section 107*d* and conversion coefficient calculation section 109*d* according to Embodiment 5 of the present invention. The signals (S11 and S51) output from wideband LSP encoding section 107*d* are different from those of the scalable encoding apparatus shown in Embodiments 1 to 4.

Since the configuration of the scalable decoding apparatus according to this embodiment is the same as the scalable decoding apparatus (see FIG. 14) shown in Embodiment 3, their explanations will be omitted.

The scalable encoding apparatus and the scalable decoding apparatus according to this embodiment have been explained so far.

Embodiment 6

The invention according to Embodiments 1 to 5 performs prediction on the current frame by actively utilizing the quantization result of the preceding frame, so that it is possible to improve quantization performance. Therefore, it is especially effective for an application with no or few transmission path errors. However, according to Embodiments 1 to 5, if a transmission path error occurs, the error may propagate to the subsequent frames for a relatively long time. More specifically, according to Embodiments 1 to 5, quantized wideband LSP is predicted from the current quantized narrowband LSP using the relationship between quantized narrowband LSP in the past and quantized wideband LSP, and, therefore, when a transmission path error occurs, there is a possibility that the quantization result which differs between the encoding apparatus and the decoding apparatus may be generated. In such a case, the decoding apparatus does not perform correct prediction in the subsequent frames, and, therefore, the error propagates to the subsequent frames. However, such error propagation occurs in Embodiments 2 to 5 only when the mode using prediction utilizing quantized LSP in the past is selected continuously, and transmission path errors occur in these continuous frames.

As the technique of improvement in such a case, a technique of incorporating a "forgetting factor" into the prediction which depends on the quantization result in the past is known (e.g., written by Allen Gersho, Robert M. ray and jointly translated by Furui, Tazaki, Kotera, Watanabe, "Vector Quantization and Information Compression", Chapter 16, from page 698 on, Subsection "Transmission Error in Gain Adaptive VQ", Corona Publishing Co., Ltd., issued on Nov. 10, 1998). According to this technique of incorporating the forgetting factor, the current quantized wideband LSP is predicted from the current quantized narrowband LSP using the sum of the prediction depending on the quantization result in the past (adaptive prediction mode component) and the prediction not depending on the quantization result in the past (fixed prediction mode component). Thus, by optimizing the ratio of the adaptive prediction mode component and the fixed prediction mode component, it is possible to achieve harmony between the quantization performance improvement effect derived from the adaptive prediction mode component and the error tolerance degradation minimization effect which derives from the fixed prediction mode component that are in a trade-off relationship.

Embodiment 6 of the present invention reduces influences of a transmission path error even when the transmission path error occurs by applying the technique of incorporating the forgetting factor in Embodiment 5. That is, in calculating quantized wideband LSP in the current frame, this embodiment uses the adaptive prediction mode component using the quantization result of the preceding frame in combination with the fixed prediction mode component (fixed value) without using the quantization result of the past frame. In this way, even when a transmission path error occurs in the frame of the adaptive prediction mode, it is possible to cause the adaptable prediction component to be forgotten using the fixed value and bring the internal state of the encoding apparatus closer to the decoding apparatus with time, and thereby reduce the influence of the transmission path error. Moreover, since this embodiment is provided with the mode of performing only fixed prediction, the internal states of the encoding apparatus and the decoding apparatus are reset together in the frame in which the mode is switched to the fixed prediction mode, propagation of the influence of the transmission path error to the subsequent frames is avoided and error tolerance is improved.

Figure 20:
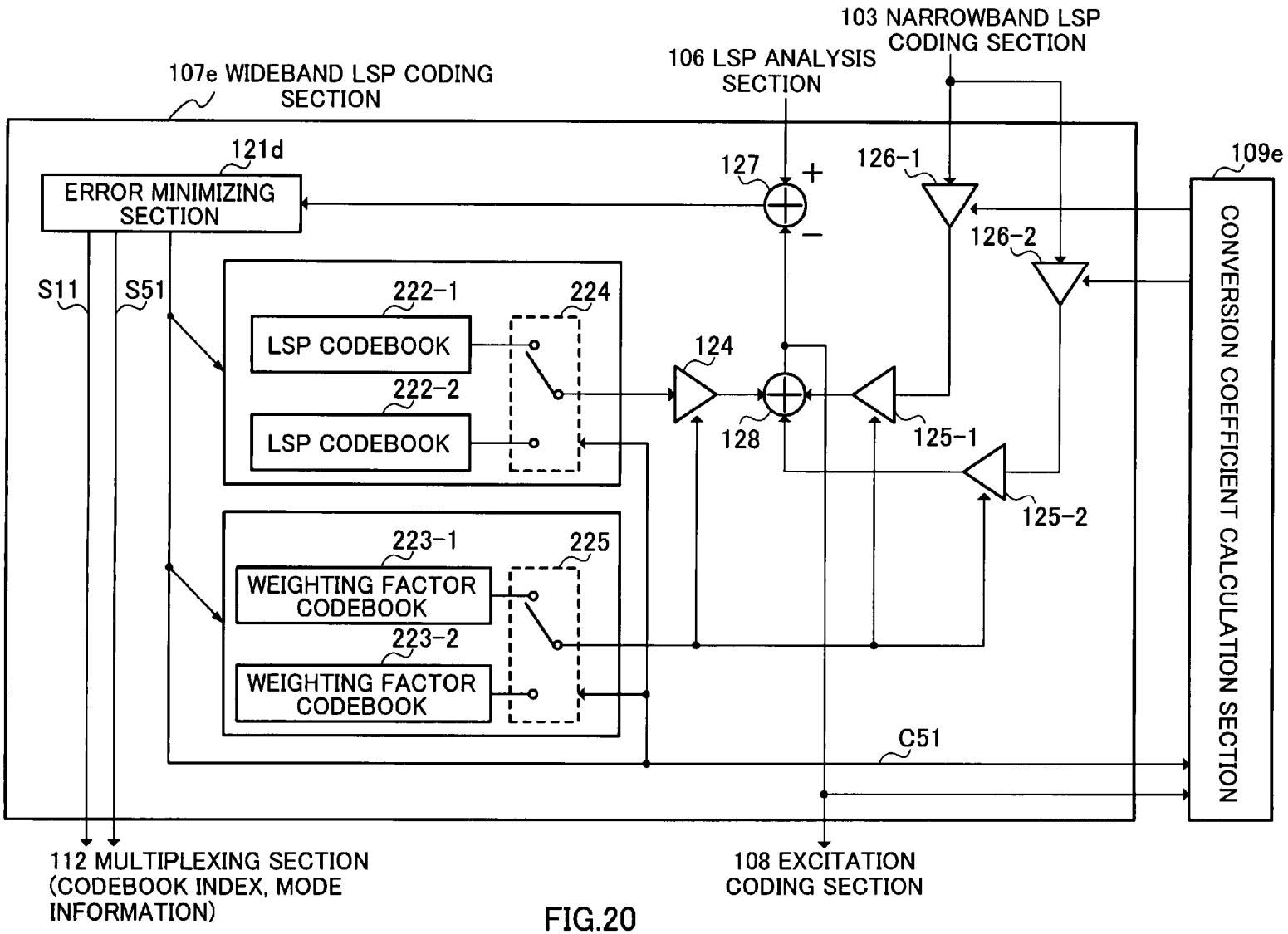
FIG. 20 is a block diagram showing the main configuration of a wideband LSP encoding section according to Embodiment 6.
Figure 21:
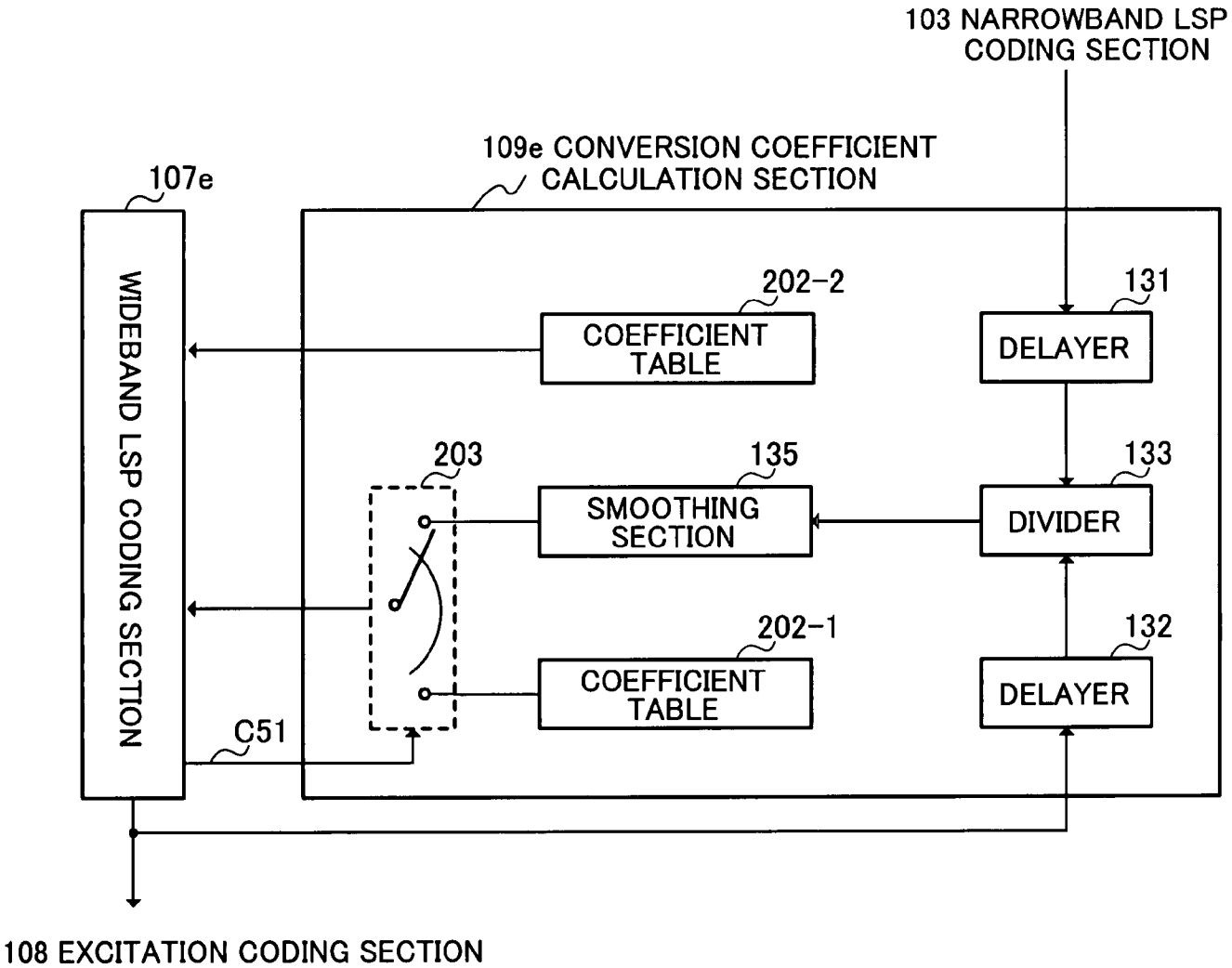
FIG. 21 is a block diagram showing the main configuration of a conversion coefficient calculation section according to Embodiment 6.

FIG. 20 is a block diagram showing the main configuration of wideband LSP encoding section 107*e* according to this embodiment. On the other hand, FIG. 21 is a block diagram showing the main configuration of conversion coefficient calculation section 109*e* according to this embodiment. This wideband LSP encoding section 107*e* and conversion coefficient calculation section 109*e* are used instead of wideband LSP encoding section 107*d* (see FIG. 17) and conversion coefficient calculation section 109*d* (see FIG. 18) in Embodiment 5. Therefore, this embodiment will explain only wideband LSP encoding section 107*e* and conversion coefficient calculation section 109*e* of the scalable encoding apparatus and the scalable decoding apparatus. Moreover, in this embodiment, components of wideband LSP encoding section 107*e* and conversion coefficient calculation section 109*e* having functions same as the components of wideband LSP encoding section 107*d* and conversion coefficient calculation section 109*d* are assigned the same reference numerals and their explanations will be omitted.

In wideband LSP encoding section 107*e*, amplifier 126-1 multiplies the LSP parameter input from narrowband LSP encoding section 103 by the conversion coefficient input from coefficient table 202-2 in conversion coefficient calculation section 109*e* and outputs the multiplication result to amplifier 125-1. On the other hand, amplifier 126-2 multiplies the LSP parameter input from narrowband LSP encoding section 103 by the conversion coefficient output from smoothing section 135 in conversion coefficient calculation section 109*e* in the case of a stationary mode (adaptive prediction mode), or by the conversion coefficient stored in coefficient table 202-1 in case of a non-stationary mode (fixed prediction mode), and outputs the multiplication result to amplifier 125-2. Therefore, amplifiers 126-1 and 126-2 constitute the multiplication section in the present invention.

Furthermore, in wideband LSP encoding section 107*e*, amplifiers 125-1 and 125-2 multiply the wideband LSP vectors input from amplifiers 126-1 and 126-2, that is, the wideband LSP vectors obtained by converting quantized narrowband LSP by specified weighting factors output from weighting factor codebooks 223-1 and 223-2, respectively, and output the multiplication result to adder 128. Then, adder 128 calculates the sum of the LSP vectors output from amplifier 124 and amplifiers 125-1 and 125-2 and outputs the addition result to adder 127.

In this way, according to this embodiment, amplifier 126-1 and amplifiers 125-1 and 125-2 always multiply quantized narrowband LSP in the current frame by the fixed conversion coefficient. That is, the signals input to adder 128 through amplifiers 126-1 and 125-1 are not influenced by transmission path errors which occurred in the past unless narrowband LSP input from encoding section 103 is influenced by transmission path errors which occurred in the past. Furthermore, in the prediction in the fixed prediction mode, amplifier 126-2 also multiplies quantized narrowband LSP by the fixed conversion coefficient(s), and therefore information is not exchanged between the preceding and subsequent frames and the influences of transmission path errors which occurred in the past do not propagate to the subsequent frames. As a result, even when a transmission path error occurs, this embodiment minimizes the propagation of influences of the errors to the subsequent frames, and can thereby improve the error tolerance.

Although the case has been explained in this embodiment where two coefficient tables 202-1 and 202-2 are arranged in conversion coefficient calculation section 109*e* and two amplifiers 126-1 and 126-2 are arranged correspondingly in wideband LSP encoding section 107*e*, the present invention is not limited to this case, and more coefficient tables 202 and amplifiers 126 may also be arranged.

Furthermore, although the case has been explained in this embodiment where there are separate coefficient tables 202-1 and 202-2 in conversion coefficient calculation section 109*e*, the present invention is not limited to this case, and it is also possible to arrange, for example, only one coefficient table 202 in conversion coefficient calculation section 109*e* so that the same conversion coefficients are input from this coefficient table 202 to two amplifiers 126-1 and 126-2 of wideband LSP encoding section 107*e*, respectively.

Furthermore, although the case has been explained in this embodiment where conversion coefficient calculation section 109*e* needs smoothing section 135, the present invention is not limited to this case, and it is possible to employ a configuration that smoothing section 135 is not arranged and an output from divider 133 is directly connected to changeover switch 203. Such a configuration allows the propagation of a transmission path error to be fully reset when changeover switch 203 switches to the coefficient table 202-1 side.

Even when conversion coefficient calculation section 109*e* is provided with smoothing section 135, if the last frame is in a fixed prediction mode (that is, changeover switch 203 is connected to the coefficient table 202-1 side), it is likewise possible to fully reset the propagation of the transmission path error if K in (Expression 4) is set to 0 or in other words, $X_n(i)=\gamma(i)$ so as to obtain the conversion coefficient applied to quantized narrowband LSP in the current frame.

Furthermore, conversion coefficient calculation section 109*e* shown in FIG. 21 can also be used instead of conversion coefficient calculation section 155*b* of the scalable decoding apparatus (see FIG. 14) shown in Embodiment 3.

The main component of a voice signal tends to gather in a low-frequency area, and, therefore, when predicting quantized wideband LSP with respect to the low-frequency component of the voice signal, if a weighting factor is designed so that the composition ratio of the adaptive prediction mode component becomes low (for example, equal to or less than 50%), and on the other hand when predicting quantized wideband LSP with respect to the high-frequency component of the voice signal, if a weighting factor is designed so that the ratio of composition of the adaptive prediction mode component becomes high (for example, equal to or more than 50%), it is possible to achieve harmony between the error tolerance and the quantization performance in the subjective quality.

Embodiment 7

In Embodiment 7 of the present invention, the ratio of the fixed prediction mode component and the adaptive prediction mode component in prediction of quantized wideband LSP in Embodiment 6 is adaptively determined per frame based on the error sensitivity of quantized narrowband LSP. That is, the weighting factors output from weighting factor codebooks 223-1 and 223-2 are specified values in Embodiment 6, but in this embodiment, weighting factor codebook 223-1 selected in the case of a stationary mode is successively updated by weighting factors calculated using quantized narrowband LSP in the current frame.

Here, when LSP is quantized, in order to take advantage of the fact that the level of subjectively permissible quantization noise differs between LSPs in the part on a spectral peak and LSPs in the part in a valley, a technique of evaluating a quantization error by a weighted Euclidean distance multiplied by a "weight" when calculating a quantization error is known. If this "weight" is used as a measure corresponding to the error sensitivity, it is possible to calculate the "weight" from quantized narrowband LSP per frame and adaptively change the ratio of the fixed prediction mode component and the adaptive prediction mode component in prediction of quantized wideband LSP according to the calculated "weight." As a result, it is possible to adjust the error tolerance and the quantization performance which are in a trade-off relationship per frame.

Figure 22:
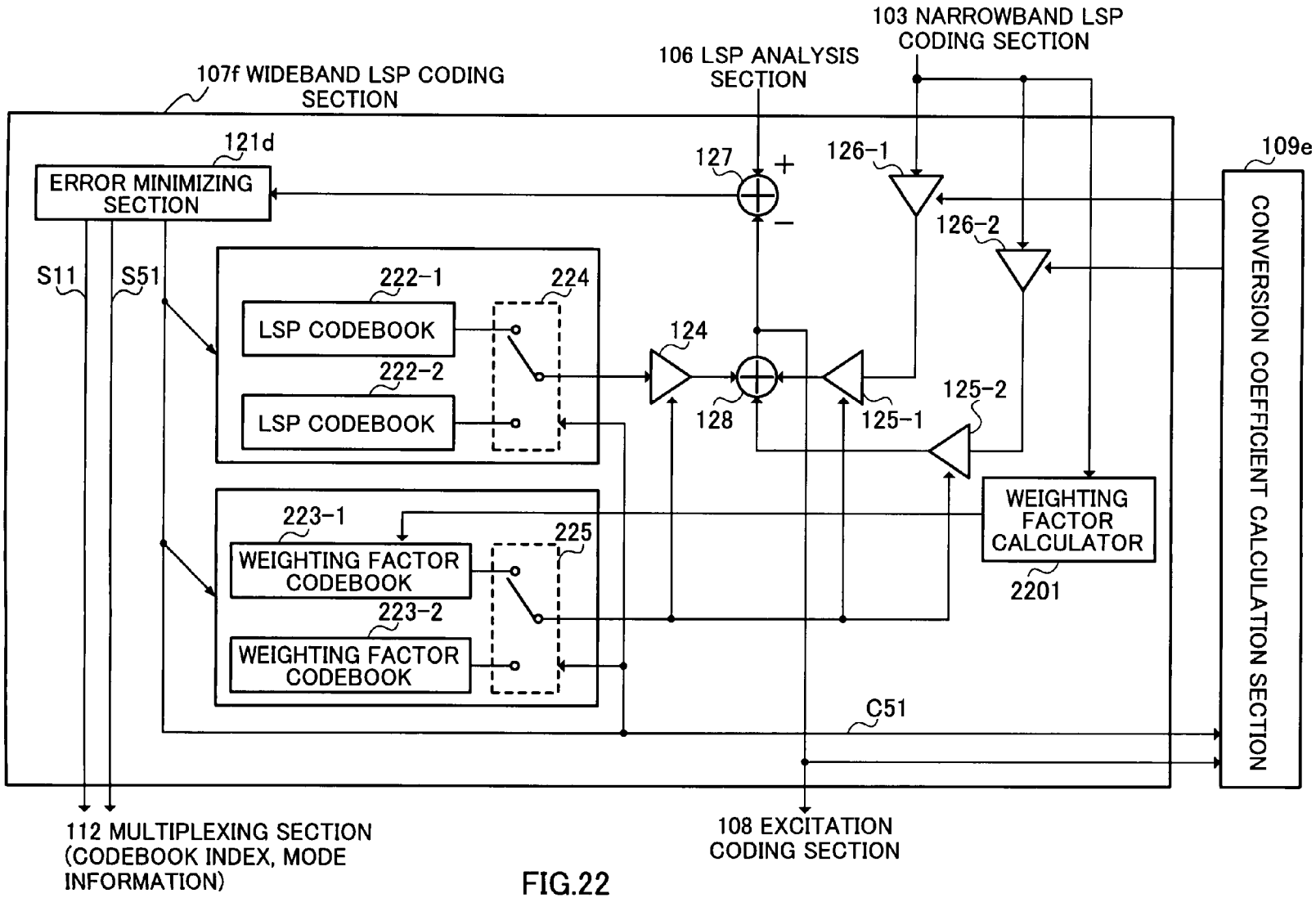
FIG. 22 is a block diagram showing the main configuration of a wideband LSP encoding section according to Embodiment 7.

FIG. 22 is a block diagram showing the main configuration of wideband LSP encoding section 107*f* according to this embodiment. This wideband LSP encoding section 107*f* is used instead of wideband LSP encoding section 107*e* (see FIG. 20) in Embodiment 6. Therefore, in this embodiment, only wideband LSP encoding section 107*f* of the scalable encoding apparatus will be explained. Moreover, in this embodiment, components of wideband LSP encoding section 107*f* having functions same as the components of wideband LSP encoding section 107*e* are assigned the same reference numerals and their explanations will be omitted.

Wideband LSP encoding section 107*f* corresponds to wideband LSP encoding section 107*e* shown in Embodiment 6 further provided with weighting factor calculator 2201. Weighting factor calculator 2201 performs "weighting according to error sensitivity" per frame and, based on quantized narrowband LSP input from narrowband LSP encoding section 103, calculates a weight described, for example, in Expression (9) of the following documents: "R. Salami et al, "Design and Description of CS-ACELP: A Toll Quality 8 kb/s Speech Coder," IEEE Trans. on Speech and Audio Process., vol. 6, no. 2, pp. 116-130, March 1998" and "K. K. Paliwal and B. S. Atal, "Efficient Vector Quantization of LPC Parameters at 24 Bits/Frame," IEEE Trans. on Speech and Audio Process., vol. 1, no. 1, pp. 3-14, January 1993". Weighting factor calculator 2201 then calculates a weighting factor for weighting factor codebook 223-1 using the calculated weight. Then, weighting factor calculator 2201 successively updates the content of the weighting factor codebook of weighting factor codebook 223-1 by the weighting factor calculated per frame. Furthermore, in this embodiment, weighting factor calculator 2201 sets a higher ratio of the fixed prediction mode component in prediction of quantized wideband LSP (for example, sets the ratio of the fixed prediction mode component equal to or more than 50%) as the calculated weight increases (as the error sensitivity increases), and, on the other hand, performs learning so as to improve the quantization performance as the weight decreases. Weighting factor calculator 2201 then updates the content of weighting factor codebook 223-1 so that the optimum composition ratio obtained by this learning (generally, the ratio of the adaptive prediction mode component becomes high).

In this way, according to this embodiment, weighting factor calculator 2201 successively updates the contents of weighting factor codebook 223-1 selected in the stationary mode based on the error sensitivity of quantized narrowband LSP in the current frame, so that it is possible to minimize error tolerance and maximize the quantization performance by optimizing the ratio of the fixed prediction mode component and the adaptive prediction mode component in prediction of quantized wideband LSP in the current frame. For example, if weighting factor calculator 2201 sets the ratio of the fixed prediction mode component to 100% when predicting quantized wideband LSP, that is, sets the ratio of the weight of amplifier 125-1 connected to amplifier 126-1 which multiplies quantized narrowband LSP by a fixed conversion coefficient to 100% and sets the ratio of amplifier 125-2 to 0%, it is possible to improve the error tolerance. On the other hand, if weighting factor calculator 2201 sets the ratio of the adaptive prediction mode component to 100%, it is possible to improve quantization performance instead of deterioration of error tolerance. Furthermore, if weighting factor calculator 2201 sets the ratio of the fixed prediction mode component and the adaptive prediction mode component to, for example, 50% and 50%, respectively, an effect of improvement in the quantization performance derived from the adaptive prediction mode component is produced and together with this effect, the fixed prediction mode component reduces the influence of the transmission path error according to the number of calculations in wideband LSP encoding section 107*f*, so that it is possible to prevent the influence of the transmission path error from propagating to the subsequent frames.

Furthermore, according to this embodiment, the contents of weighting factor codebook 223-1 are successively updated by weighting factor calculator 2201 per frame, so that, even when the error sensitivity of quantized narrowband LSP changes every frame, it is possible to adaptively achieve harmony between the quantization performance improvement effect derived from the adaptive prediction mode component and the error tolerance degradation minimization effect derived from the fixed prediction mode component that are in a trade-off relationship.

In case of a voice signal, even if an LSP parameter with regard to the high-frequency component is wrong, the influence on the subjective quality is relatively small, and, therefore, weighting factor calculator 2201 preferably determines a weighting factor so that the ratio of the fixed prediction mode component becomes high with respect to the low-frequency component and the ratio of the adaptive prediction mode component becomes high with respect to the high-frequency component.

Although the case has been explained in this embodiment where weighting factor multiplier 2201 calculates a weighting factor for weighting factor codebook 223-1 based on the error sensitivity of quantized narrowband LSP, the present invention is not limited to this case, and weighting factor multiplier 2201 may calculate a weighting factor for weighting factor codebook 223-1 from off-line learning data.

The embodiments of the present invention have been explained so far.

The scalable encoding apparatus and scalable decoding apparatus according to the present invention are not limited to the above-described embodiments but can be modified and implemented in various ways. For example, the embodiments can be implemented in combination with each other as appropriate.

The scalable encoding apparatus and the scalable decoding apparatus according to the present invention can also be mounted on a communication terminal apparatus or a base station apparatus in a mobile communication system. By this means, it is possible to provide a communication terminal apparatus or a base station apparatus having operations and effects same as those described above.

Here, the case where LSP parameters are encoded/decoded has been explained, but the present invention is also applicable to ISP (Immittance Spectrum Pairs) parameters.

Furthermore, a cosine of LSP, that is, cos(L(i)) when LSP is assumed to be L(i) is particularly called an "LSF (Line Spectral Frequency)" and may be distinguished from LSP, but according to the present specification, LSF is one form of LSP and the term "LSP" is used assuming that LSF is included in LSP. That is, LSP may be read as LSF.

Also, here, the ratio of the quantized wideband/narrowband LSP parameters in the previous frame is assumed to be a narrowband-wideband conversion coefficient(s) in the current frame, and further, using a set of the ratio of the quantized wideband/narrowband LSP parameters in the past frames as time series, the ratio of the quantized wideband/narrowband LSP parameters in the current frame may be predicted or calculated through extrapolation, and the calculated value may be used as a narrowband-wideband conversion coefficient(s) in the current frame.

Although the case has been explained as an example here where the mode consists of two modes, that is, a stationary mode and a non-stationary mode, there may be three or more modes.

Furthermore, although the case has been explained as an example here where band scalable encoding includes two layers, that is, the band scalable encoding or the band scalable decoding including two frequency bands of a narrowband and wideband, the present invention is also applicable to band scalable encoding or band scalable decoding including three or more frequency bands (layers).

Also, although the case has been explained as an example here where the present invention is implemented by hardware, the present invention can also be implemented by software. For example, the same functions as the scalable encoding apparatus or the scalable decoding apparatus of the present invention can be realized by describing an algorithm of the scalable encoding method or the scalable decoding method according to the present invention in a programming language, storing this program in memory and causing an information processing section to execute the program.

In addition, each of functional blocks employed in the description of each of above mentioned Embodiments may typically be implemented as an LSI constituted by an integrated circuit. These are may be individual chips or partially or totally contained on a single chip.

"LSI" is adopted here but this may also be referred to as an "IC", "system LSI", "super LSI", or "ultra LSI" depending on differing extents of integration.

Further, the method of integrating circuits is not limited to the LSI's, and implementation using dedicated circuitry or general purpose processor is also possible. After LSI manufacture, utilization of FPGA (Field Programmable Gate Array) or a reconfigurable processor where connections or settings of circuit cells within an LSI can be reconfigured is also possible.

Furthermore, if integrated circuit technology comes out to replace LSI's as a result of the advancement of semiconductor technology or derivative other technology, it is naturally also possible to carry out function block integration using this technology. Application in biotechnology is also possible.

The present application is based on Japanese Patent Application No. 2004-132113 filed on Apr. 27, 2004 and Japanese Patent Application No. 2004-259036 filed on Sep. 6, 2004, the entire content of which is expressly incorporated by reference herein.

INDUSTRIAL APPLICABILITY

The scalable encoding apparatus, scalable decoding apparatus, scalable encoding method and scalable decoding method according to the present invention can be applied to the use of a communication apparatus in a mobile communication system or packet communications system using an Internet protocol and so on.

The invention claimed is:

1. A scalable encoding apparatus that generates a quantized line spectrum pair (LSP) parameter of narrowband and wideband signals having scalability in a frequency axis direction from an input signal, the scalable encoding apparatus comprising:

a narrowband encoding section configured as a circuit that encodes an LSP parameter of a narrowband input signal and generates a first quantized LSP parameter of the narrowband signal;

a conversion section that converts a frequency band of said first quantized LSP parameter to a wideband;

a wideband encoding section that encodes the LSP parameter of a wideband input signal using said first quantized LSP parameter after conversion to the wideband and generates a second quantized LSP parameter of the wideband signal; and a calculation section that calculates a set of conversion coefficients used by said conversion section based on a relationship between said first and second quantized LSP parameters generated in the past.

2. The scalable encoding apparatus according to claim 1, further comprising a limiter that makes a correction on the conversion coefficient calculated by said calculation section so that the conversion coefficient is within a predetermined range.

3. The scalable encoding apparatus according to claim 1, further comprising a smoothing section that enables smooth transition of the conversion coefficient calculated by said calculation section along the time axis.

4. The scalable encoding apparatus according to claim 1, wherein:

said calculation section comprises a coefficient table holding one or a plurality of conversion coefficients beforehand; and said calculation section switches between the conversion coefficients calculated based on the relationship between said first and second quantized LSP parameters generated in the past and the conversion coefficients pre-stored in said coefficient table according to a voice mode of said input signal and outputs the conversion coefficients.

5. The scalable encoding apparatus according to claim 4, wherein the voice mode of said input signal is determined based on a time variation of said first quantized LSP of the narrowband signal.

6. The scalable encoding apparatus according to claim 4, wherein the voice mode of said input signal is determined based on a change over time of the LSP parameter of said wideband input signal.

7. The scalable encoding apparatus according to claim 4, wherein the voice mode of said input signal is determined based on a conversion gain of said conversion coefficients.

8. The scalable encoding apparatus according to claim 4, wherein the voice mode of said input signal is determined in a closed loop manner based on a quantization error.

9. The scalable encoding apparatus according to claim 4, wherein the voice mode of said input signal is transmitted to a decoding apparatus.

10. The scalable encoding apparatus according to claim 1, further comprising an addition section that adds said first quantized LSP parameter obtained by said conversion section, wherein:

said calculation section comprises a coefficient table which pre-stores one or more sets of conversion coefficients beforehand and outputs both the set of conversion coefficients calculated based on the relationship between said first and second quantized LSP parameters generated in the past and the set of conversion coefficients pre-stored in said coefficient table;

said conversion section separately multiplies said first quantized LSP parameter by at least two said set of conversion coefficients output from said calculation section, converts the frequency band of said first quantized LSP parameter to a wideband and generates at least two said first quantized LSP parameters after conversion to the wideband;

said addition section sums at least two said first quantized LSP parameters converted to the wideband by said conversion section; and said wideband encoding section encodes the LSP parameter of the wideband input signal using said first quantized LSP parameter after the addition by said addition section and generates a second quantized LSP parameter of the wideband signal.

11. The scalable encoding apparatus according to claim 10, further comprising:

a multiplication section that separately multiplies at least two said first quantized LSP parameters converted to the wideband by said conversion section by predetermined weighting factors; and a weighting factor calculation section that calculates said weighting factors used in said multiplication section, wherein said addition section sums at least two said first quantized LSP parameters multiplied by said weighting factors by said multiplication section, and said weighting factor calculation section calculates said weighting factors used in said multiplication section based on error sensitivity of said first quantized LSP parameters.

12. A communication terminal apparatus comprising the scalable encoding apparatus according to claim 1.

13. A base station apparatus comprising the scalable encoding apparatus according to claim 1.

14. A scalable decoding apparatus that decodes a quantized line spectrum pair (LSP) parameter of narrowband and wideband signals having scalability in a frequency axis direction, the scalable decoding apparatus comprising:

a narrowband decoding section configured as a circuit that decodes the quantized LSP parameter of the narrowband signal and generates a first LSP parameter of the narrowband signal;

a conversion section that converts a frequency band of said first LSP parameter to a wideband;

a wideband decoding section that decodes the quantized LSP parameter of the wideband signal using said first LSP parameter after conversion to the wideband and generates a second LSP parameter of the wideband signal; and a calculation section that calculates a set of conversion coefficients used in said conversion section based on a relationship between said first and second LSP parameters generated in the past.

15. A communication terminal apparatus comprising the scalable decoding apparatus according to claim 14.

16. A base station apparatus comprising the scalable decoding apparatus according to claim 14.

17. A scalable encoding method that generates a quantized line spectrum pair (LSP) parameter of narrowband and wideband signals having scalability in a frequency axis direction from an input signal, the scalable encoding method comprising:

encoding an LSP parameter of a narrowband input signal and generating a first quantized LSP parameter of the narrowband signal;

converting a frequency band of said first quantized LSP parameter to a wideband;

encoding the LSP parameter of a wideband input signal using said first quantized LSP parameter after conversion to the wideband and generating a second quantized LSP parameter of the wideband signal; and calculating a set of conversion coefficients used during the converting based on a relationship between said first and second quantized LSP parameters generated in the past.

18. A scalable decoding method that decodes a quantized line spectrum pair (LSP) parameter of narrowband and wideband signals having scalability in a frequency axis direction, the scalable decoding apparatus comprising:

decoding the quantized LSP parameter of the narrowband signal and generating a first LSP parameter of the narrowband signal;

converting a frequency band of said first LSP parameter to a wideband;

decoding the quantized LSP parameter of the wideband signal using said first LSP parameter after conversion to the wideband and generating a second LSP parameter of the wideband signal; and calculating a set of conversion coefficients used in said converting based on a relationship between said first and second LSP parameters generated in the past.

* * * * *